US011819079B2

(12) United States Patent
Lotti

(10) Patent No.: US 11,819,079 B2
(45) Date of Patent: Nov. 21, 2023

(54) STACKING ARTIFICIAL LASH EXTENSIONS

(71) Applicant: Lashify, Inc., North Hollywood, CA (US)

(72) Inventor: Sahara Lotti, North Hollywood, CA (US)

(73) Assignee: Lashify, Inc., North Hollywood, CA (US)

( * ) Notice: Subject to any disclaimer, the term of this patent is extended or adjusted under 35 U.S.C. 154(b) by 0 days.

(21) Appl. No.: 17/878,787

(22) Filed: Aug. 1, 2022

(65) Prior Publication Data

US 2022/0369749 A1 Nov. 24, 2022

Related U.S. Application Data

(62) Division of application No. 17/061,192, filed on Oct. 1, 2020, now Pat. No. 11,432,608.

(60) Provisional application No. 62/909,904, filed on Oct. 3, 2019.

(51) Int. Cl.
*A41G 5/00* (2006.01)
*A41G 5/02* (2006.01)

(52) U.S. Cl.
CPC ..... *A41G 5/02* (2013.01)

(58) Field of Classification Search
CPC ..... A41G 5/02
USPC ..... D28/92
See application file for complete search history.

(56) References Cited

U.S. PATENT DOCUMENTS 1,021,063 A 3/1912 Miller
1,450,259 A 4/1923 Nessler
1,831,801 A 11/1931 Birk
1,897,747 A 2/1933 Birk
1,920,401 A 8/1933 Kahn
2,013,011 A 9/1935 Sheldon
D101,791 S 11/1936 Rauh
2,079,256 A 5/1937 Kaiser
D129,526 S 9/1941 Hanisch
(Continued)

FOREIGN PATENT DOCUMENTS

CA 2904764 * 9/2014
EP 1839526 A1 10/2007
(Continued)

OTHER PUBLICATIONS

"The Process of Making Regular Eyelash Products, YouTube (Nov. 12, 2015),https://www.youtube.com/watch?v=mVATdu3dw5c".
(Continued)

*Primary Examiner* — Rachel R Steitz
(74) *Attorney, Agent, or Firm* — Lowenstein Sandler LLP

(57) ABSTRACT

An artificial lash extension system includes lash extensions designed for an application under a natural lash. First lash extensions designed for an application at an underside of upper natural lashes each include first artificial hairs and a first base from which the first artificial hairs protrude, wherein the first base includes a top side designed to attach to the underside of the upper natural lashes. Second lash extensions designed for an application under the first plurality of lashes each include second artificial hairs, and a second base from which the second artificial hairs protrude, wherein the second base includes a top side designed to attach to at least part of a bottom side of one or more of the first lash extensions.

17 Claims, 12 Drawing Sheets

(56) References Cited

U.S. PATENT DOCUMENTS

| | | | |
|---|---|---|---|
| 2,268,082 | A | 12/1941 | Phillips, Sr. |
| 2,323,595 | A | 7/1943 | Hanisch |
| 2,392,694 | A | 1/1946 | Rector |
| 2,421,432 | A | 6/1947 | Phillips |
| D154,227 | S | 6/1949 | Alvizua |
| D155,559 | S | 10/1949 | Tillmann |
| 2,618,279 | A | 11/1952 | Reiffert |
| 2,812,768 | A | 11/1957 | Giuliano |
| D189,888 | S | 3/1961 | Tapper |
| 3,016,059 | A | 1/1962 | Hutton |
| 3,032,042 | A | 5/1962 | Meehan |
| 3,032,342 | A | 5/1962 | Glass |
| 3,174,321 | A | 3/1965 | Williams |
| 3,245,416 | A | 4/1966 | Aylott |
| 3,295,534 | A | 1/1967 | Dorkin |
| 3,343,552 | A | 9/1967 | Steffen |
| 3,392,727 | A | 7/1968 | Hanlon |
| 3,447,540 | A | 6/1969 | Osher |
| 3,454,015 | A | 7/1969 | Udes |
| 3,478,754 | A | 11/1969 | Martin, Jr. |
| 3,547,135 | A | 12/1970 | Roos |
| 3,557,653 | A | 1/1971 | Kim |
| 3,561,454 | A | 2/1971 | Oconnell |
| 3,625,229 | A | 12/1971 | Silson |
| 3,645,281 | A | 2/1972 | Seidler |
| 3,670,742 | A | 6/1972 | Weaner |
| 3,703,180 | A | 11/1972 | Aylott |
| 3,828,803 | A | 8/1974 | Windsor |
| 3,833,007 | A | 9/1974 | Jacobs |
| 3,900,038 | A | 8/1975 | Masters |
| D240,769 | S | 7/1976 | Bowman |
| 3,968,807 | A | 7/1976 | Kraicer |
| 3,970,092 | A | 7/1976 | Nelson |
| 3,970,992 | A | 7/1976 | Boothroyd et al. |
| 3,971,392 | A | 7/1976 | Brehmer |
| 3,980,092 | A | 9/1976 | Garufi |
| 3,982,313 | A | 9/1976 | Nelson, Jr. |
| 4,016,889 | A | 4/1977 | Cowles |
| 4,029,111 | A | 6/1977 | Barton |
| 4,049,006 | A | 9/1977 | Saunders et al. |
| 4,163,535 | A | 8/1979 | Austin |
| 4,168,713 | A | 9/1979 | Agiotis |
| 4,203,518 | A | 5/1980 | Current |
| 4,205,693 | A | 6/1980 | Mallouf |
| 4,225,693 | A | 9/1980 | McCormick |
| 4,254,772 | A | 3/1981 | McNamee |
| 4,254,784 | A | 3/1981 | Nelson |
| 4,284,092 | A | 8/1981 | Auretta |
| 4,296,765 | A | 10/1981 | Bachtell |
| D261,601 | S | 11/1981 | Kettlestrings |
| 4,299,242 | A | 11/1981 | Choe |
| 4,360,033 | A | 11/1982 | Schmehling |
| 4,395,824 | A | 8/1983 | Puro |
| D270,551 | S | 9/1983 | Thayer |
| 4,458,701 | A | 7/1984 | Holland |
| 4,509,539 | A | 4/1985 | Alfieri |
| D280,354 | S | 8/1985 | Bakic |
| D281,259 | S | 11/1985 | Hensley |
| D281,825 | S | 12/1985 | Bakic |
| 4,600,029 | A | 7/1986 | Jeberschaar |
| 4,697,856 | A | 10/1987 | Abraham |
| 4,739,777 | A | 4/1988 | Nelson |
| 4,767,492 | A | 8/1988 | Fukusima |
| D298,070 | S | 10/1988 | Ferrari |
| 4,784,713 | A | 11/1988 | Van Nieulande |
| D299,561 | S | 1/1989 | Bakic |
| D301,371 | S | 5/1989 | Kaprelian |
| D302,602 | S | 8/1989 | Bakic |
| 4,865,057 | A | 9/1989 | Braun |
| 4,934,387 | A | 6/1990 | Megna |
| 4,964,428 | A | 10/1990 | Lamatrice |
| D314,066 | S | 1/1991 | Bakic |
| 5,010,914 | A | 4/1991 | Merges |
| D318,346 | S | 7/1991 | Bakic |
| 5,033,626 | A | 7/1991 | Platti |
| 5,072,745 | A | 12/1991 | Cheh |
| 5,082,010 | A | 1/1992 | Skaryd et al. |
| 5,117,846 | A | 6/1992 | Finamore et al. |
| D328,246 | S | 7/1992 | Nottingham et al. |
| 5,154,195 | A | 10/1992 | Irisawa |
| D342,671 | S | 12/1993 | Elliott |
| D343,340 | S | 1/1994 | Frye, Jr. et al. |
| 5,307,826 | A | 5/1994 | Iosilevich |
| D348,219 | S | 6/1994 | Goldberg |
| 5,322,166 | A | 6/1994 | Crowther |
| 5,368,052 | A | 11/1994 | Finamore |
| 5,377,700 | A | 1/1995 | Harris |
| D358,312 | S | 5/1995 | Keenan |
| D358,908 | S | 5/1995 | Rawski |
| 5,411,775 | A | 5/1995 | Wilson |
| 5,419,345 | A | 5/1995 | Kadymir |
| D359,583 | S | 6/1995 | Abbo |
| D368,495 | S | 4/1996 | Rypinski |
| 5,533,529 | A | 7/1996 | Ohno |
| 5,547,529 | A | 8/1996 | Woolf |
| D373,726 | S | 9/1996 | Power |
| 5,571,543 | A | 11/1996 | Song et al. |
| D379,923 | S | 6/1997 | De Baschmakoff |
| D380,616 | S | 7/1997 | Leslie et al. |
| D382,198 | S | 8/1997 | Mulhauser et al. |
| D386,808 | S | 11/1997 | Litton |
| D387,483 | S | 12/1997 | Sloan |
| D388,549 | S | 12/1997 | Mouyiaris et al. |
| 5,746,232 | A | 5/1998 | Martin et al. |
| 5,765,571 | A | 6/1998 | Dinnel |
| D397,040 | S | 8/1998 | Bakic |
| 5,813,418 | A | 9/1998 | Pillars |
| D403,922 | S | 1/1999 | Terracciano et al. |
| D404,531 | S | 1/1999 | Bakic et al. |
| 5,894,846 | A | 4/1999 | Gang |
| 5,896,996 | A | 4/1999 | Chuang |
| D411,649 | S | 6/1999 | Bakic |
| D418,018 | S | 12/1999 | Winsted |
| D418,253 | S | 12/1999 | Bakic |
| 6,003,467 | A | 12/1999 | Shelton-Ferrell et al. |
| 6,016,814 | A | 1/2000 | Elliott |
| 6,019,107 | A | 2/2000 | Overmyer et al. |
| 6,029,674 | A | 2/2000 | Han |
| 6,032,609 | A | 3/2000 | Luoma |
| 6,035,861 | A | 3/2000 | Copello |
| 6,092,291 | A | 7/2000 | Cendoma |
| 6,109,274 | A | 8/2000 | Ingersoll |
| D437,086 | S | 1/2001 | Dickert |
| 6,174,321 | B1 | 1/2001 | Webb |
| 6,182,839 | B1 | 2/2001 | Robbins et al. |
| D442,304 | S | 5/2001 | Huang |
| 6,230,715 | B1 | 5/2001 | Cho |
| D443,471 | S | 6/2001 | Lillelund et al. |
| 6,247,476 | B1 | 6/2001 | Sartena |
| 6,257,250 | B1 | 7/2001 | Sartena |
| 6,265,010 | B1 | 7/2001 | Franco |
| D448,927 | S | 10/2001 | Vazquez |
| 6,302,115 | B1 | 10/2001 | Sartena |
| 6,308,716 | B1 | 10/2001 | Han |
| D452,151 | S | 12/2001 | Scott |
| D454,981 | S | 3/2002 | Lamagna et al. |
| D456,077 | S | 4/2002 | Etter et al. |
| D456,097 | S | 4/2002 | LaMagna et al. |
| D458,413 | S | 6/2002 | Boilen |
| 6,405,736 | B2 | 6/2002 | Townsend |
| 6,439,406 | B1 | 8/2002 | Duhon |
| D463,280 | S | 9/2002 | Brozell |
| D463,744 | S | 10/2002 | Brozell |
| D464,565 | S | 10/2002 | Weinstein et al. |
| D464,877 | S | 10/2002 | Weinstein et al. |
| 6,471,515 | B2 | 10/2002 | Feuer |
| D467,800 | S | 12/2002 | Chen et al. |
| 6,494,212 | B1 | 12/2002 | Yamakoshi |
| 6,530,379 | B2 | 3/2003 | Iosilevich |
| D472,675 | S | 4/2003 | Lamagna |
| D472,810 | S | 4/2003 | Gelardi et al. |
| D473,106 | S | 4/2003 | Scherer |
| 6,561,197 | B2 | 5/2003 | Harrison |
| 6,567,640 | B2 | 5/2003 | Ishikawa |

(56) References Cited

U.S. PATENT DOCUMENTS

| | | | |
|---|---|---|---|
| D475,616 | S | 6/2003 | Lambrecht |
| 6,581,609 | B2 | 6/2003 | Ott |
| D479,365 | S | 9/2003 | Todeschini |
| D480,864 | S | 10/2003 | Sayers et al. |
| D481,946 | S | 11/2003 | Nicholson et al. |
| D481,952 | S | 11/2003 | Orsomando |
| D482,495 | S | 11/2003 | Jackel-Marken |
| D482,928 | S | 12/2003 | Liu |
| D482,934 | S | 12/2003 | Liu |
| D483,232 | S | 12/2003 | Liu |
| D483,633 | S | 12/2003 | Jansson et al. |
| D483,909 | S | 12/2003 | Todeschini |
| D485,359 | S | 1/2004 | McMichael et al. |
| 6,688,315 | B1 | 2/2004 | Harrison |
| 6,691,714 | B1 | 2/2004 | Yaguchi et al. |
| 6,708,696 | B2 | 3/2004 | Ferguson |
| D488,353 | S | 4/2004 | Govrik et al. |
| D488,618 | S | 4/2004 | Wekstein |
| D490,932 | S | 6/2004 | Mammone |
| D491,336 | S | 6/2004 | Cecere |
| D495,834 | S | 9/2004 | Todeschini |
| D496,759 | S | 9/2004 | Rodriguez |
| 6,820,625 | B2 | 11/2004 | Park |
| D501,580 | S | 2/2005 | Sugawara |
| D506,573 | S | 6/2005 | de Grandcourt |
| D507,678 | S | 7/2005 | Lamagna |
| 6,935,348 | B2 | 8/2005 | Gold |
| 6,935,349 | B2 | 8/2005 | Nicot et al. |
| D509,942 | S | 9/2005 | Connolly et al. |
| D512,913 | S | 12/2005 | Gauthier |
| 6,973,931 | B1 | 12/2005 | King |
| 6,981,814 | B2 | 1/2006 | Geardino et al. |
| D515,242 | S | 2/2006 | Cho |
| D516,247 | S | 2/2006 | Merheje |
| 7,000,775 | B2 | 2/2006 | Gelardi et al. |
| 7,036,518 | B2 | 5/2006 | Park |
| D522,376 | S | 6/2006 | Hales |
| D532,891 | S | 11/2006 | Buthier et al. |
| D533,650 | S | 12/2006 | Ohta |
| D534,426 | S | 1/2007 | Bakic |
| 7,159,720 | B2 | 1/2007 | Pearson |
| 7,168,432 | B1 | 1/2007 | Brumfield |
| D537,208 | S | 2/2007 | Shaljian |
| D540,112 | S | 4/2007 | Nichols et al. |
| D543,662 | S | 5/2007 | Bivona et al. |
| D543,815 | S | 6/2007 | Metcalf |
| D543,850 | S | 6/2007 | Legros |
| D544,148 | S | 6/2007 | Bivona et al. |
| D544,202 | S | 6/2007 | Markfelder |
| D545,396 | S | 6/2007 | Casey et al. |
| 7,228,863 | B2 | 6/2007 | Dumler et al. |
| D546,002 | S | 7/2007 | Bowen |
| D547,940 | S | 8/2007 | Sandy |
| D559,457 | S | 1/2008 | Garland et al. |
| D561,045 | S | 2/2008 | Lee |
| D561,942 | S | 2/2008 | Khubani |
| 7,331,351 | B1 | 2/2008 | Asai |
| D563,157 | S | 3/2008 | Bouveret et al. |
| D563,616 | S | 3/2008 | Lynde et al. |
| D563,728 | S | 3/2008 | Welch, III |
| 7,343,921 | B2 | 3/2008 | Salinas |
| D569,041 | S | 5/2008 | Azoulay |
| D569,553 | S | 5/2008 | Cho |
| 7,374,048 | B2 | 5/2008 | Mazurek |
| D571,543 | S | 6/2008 | Sungadi |
| D573,308 | S | 7/2008 | Wittke-Kothe |
| D575,904 | S | 8/2008 | Iqbal |
| D579,059 | S | 10/2008 | Chan |
| 7,469,701 | B1 | 12/2008 | Bernard |
| D584,449 | S | 1/2009 | Shaljian |
| D587,529 | S | 3/2009 | Pratt |
| D588,746 | S | 3/2009 | Ross |
| D591,599 | S | 5/2009 | Okin et al. |
| D592,923 | S | 5/2009 | Konopka |
| 7,533,676 | B2 | 5/2009 | Sthair |
| D595,054 | S | 6/2009 | Whitaker |
| 7,543,718 | B2 | 6/2009 | Simon |
| D600,441 | S | 9/2009 | Estrada |
| D602,354 | S | 10/2009 | Dibnah et al. |
| 7,600,519 | B2 | 10/2009 | Dinh |
| D604,579 | S | 11/2009 | Robinson et al. |
| 7,610,921 | B2 | 11/2009 | Gold |
| D605,514 | S | 12/2009 | Weber |
| D607,332 | S | 1/2010 | Huntington et al. |
| D615,290 | S | 5/2010 | Heffner |
| D617,187 | S | 6/2010 | Murray |
| D617,943 | S | 6/2010 | Bouix et al. |
| D618,078 | S | 6/2010 | Cripps et al. |
| 7,748,391 | B2 | 7/2010 | Vance |
| D627,103 | S | 11/2010 | Cho |
| 7,836,899 | B2 | 11/2010 | Sugai et al. |
| D631,606 | S | 1/2011 | Chen |
| 7,896,192 | B2 | 3/2011 | Conley et al. |
| D638,733 | S | 5/2011 | Sullivan et al. |
| 7,938,128 | B2 | 5/2011 | Gueret |
| D639,196 | S | 6/2011 | Sullivan et al. |
| D640,005 | S | 6/2011 | Lee et al. |
| D640,834 | S | 6/2011 | Chen |
| D641,106 | S | 7/2011 | Williams et al. |
| 8,015,980 | B2 | 9/2011 | Rabe et al. |
| 8,025,065 | B2 | 9/2011 | Guliker |
| 8,042,553 | B2 | 10/2011 | Paris |
| D647,799 | S | 11/2011 | Dunwoody |
| 8,061,367 | B2 | 11/2011 | Rabe et al. |
| D650,669 | S | 12/2011 | Dunwoody |
| D650,670 | S | 12/2011 | Dunwoody |
| D651,082 | S | 12/2011 | Dunwoody |
| 8,113,218 | B2 | 2/2012 | Nguyen |
| 8,127,774 | B2 | 3/2012 | Dinh |
| D657,496 | S | 4/2012 | Flatt |
| D657,696 | S | 4/2012 | Floyd et al. |
| D659,330 | S | 5/2012 | Davis |
| 8,171,943 | B2 | 5/2012 | Hamano |
| 8,186,361 | B2 | 5/2012 | Hampton |
| D661,185 | S | 6/2012 | Battat |
| D661,599 | S | 6/2012 | Floyd et al. |
| 8,191,556 | B2 | 6/2012 | Betts |
| 8,196,591 | B2 | 6/2012 | Lee et al. |
| 8,205,761 | B2 | 6/2012 | Stull, Sr. et al. |
| D663,113 | S | 7/2012 | Simms |
| D664,011 | S | 7/2012 | Affonso |
| 8,225,800 | B2 | 7/2012 | Byrne |
| D669,223 | S | 10/2012 | Lee et al. |
| D670,030 | S | 10/2012 | Nguyen |
| D673,325 | S | 12/2012 | Martines |
| 8,342,186 | B2 | 1/2013 | Freelove |
| 8,347,896 | B2 | 1/2013 | Liao |
| D679,590 | S | 4/2013 | Stull, Sr. et al. |
| D679,591 | S | 4/2013 | Stull, Sr. et al. |
| D679,592 | S | 4/2013 | Stull, Sr. et al. |
| D679,595 | S | 4/2013 | Stull, Sr. et al. |
| D679,596 | S | 4/2013 | Stull, Sr. et al. |
| D682,103 | S | 5/2013 | Jedlicka et al. |
| D682,688 | S | 5/2013 | Murray |
| 8,434,500 | B2 | 5/2013 | Alex |
| D686,495 | S | 7/2013 | Murray |
| D690,419 | S | 9/2013 | Porat |
| 8,528,571 | B2 | 9/2013 | Costa |
| 8,567,640 | B1 | 10/2013 | Johnson-Lofton |
| 8,578,946 | B2 | 11/2013 | Ellery |
| 8,596,284 | B2 | 12/2013 | Byrne |
| 8,616,223 | B2 | 12/2013 | Rabe et al. |
| D698,078 | S | 1/2014 | Purizhansky et al. |
| 8,657,170 | B2 | 2/2014 | Martinez |
| D700,799 | S | 3/2014 | Ludeman et al. |
| D702,510 | S | 4/2014 | Segal |
| 8,701,685 | B2 | 4/2014 | Chipman |
| D707,392 | S | 6/2014 | Yu et al. |
| D707,556 | S | 6/2014 | Kawamura |
| 8,739,803 | B2 | 6/2014 | Freelove |
| 8,752,562 | B2 | 6/2014 | Dinh |
| D709,129 | S | 7/2014 | Moertl |
| D711,227 | S | 8/2014 | Sheikh |
| D713,217 | S | 9/2014 | Micara-Sartori et al. |

(56) References Cited

U.S. PATENT DOCUMENTS

D714,494 S 9/2014 Vasquez et al.
8,826,919 B2 9/2014 Dinh
D716,498 S 10/2014 Wolff
D717,038 S 11/2014 Lee
8,875,718 B2 11/2014 Dinh
8,881,741 B1 11/2014 Mattson et al.
8,881,744 B2 11/2014 McKinstry
D718,901 S 12/2014 Parker
8,939,159 B2 1/2015 Yeo et al.
8,967,158 B2 3/2015 Sanbonmatsu
9,004,076 B2 4/2015 Le
9,004,299 B2 4/2015 Hardin
9,027,568 B2 5/2015 Lee
9,044,076 B2 6/2015 Temple
9,078,480 B2 7/2015 Beschta
9,107,461 B2 8/2015 Martins et al.
D738,579 S 9/2015 Owens et al.
D738,611 S 9/2015 Gupta
9,149,083 B1 10/2015 Dinh
9,155,345 B2 10/2015 Nisim et al.
9,179,722 B2 11/2015 Le
9,185,943 B2 11/2015 Merszei
D746,046 S 12/2015 Lee
D746,514 S 12/2015 Lambridis et al.
9,215,901 B1 12/2015 Schroeder
9,254,012 B2 2/2016 Pham
D751,904 S 3/2016 Landrum et al.
9,277,777 B2 3/2016 Lee et al.
9,284,111 B2 3/2016 Huang
D753,455 S 4/2016 Hyma et al.
D753,881 S 4/2016 Hussain et al.
9,314,085 B2 4/2016 Hatch
D755,577 S 5/2016 Segal
D757,274 S 5/2016 Gelb et al.
D758,009 S 5/2016 Berkos
9,339,072 B2 5/2016 Kenna
9,351,752 B2 5/2016 Slavin
D761,489 S 7/2016 Krakovszki
D762,433 S 8/2016 Yang
D764,688 S 8/2016 Robinson et al.
D765,909 S 9/2016 Marchica et al.
9,439,465 B2 9/2016 Ott
9,451,800 B2 9/2016 Dinh
9,456,646 B2 10/2016 Calina
9,462,837 B2 10/2016 Ngo
9,468,245 B2 10/2016 Woods
D771,318 S * 11/2016 Taff ..... D28/92
9,486,025 B1 11/2016 Dinh
9,504,285 B2 11/2016 Lin
D773,915 S 12/2016 Barakat et al.
D775,270 S 12/2016 Moffat
9,516,908 B2 12/2016 Miyatake et al.
9,565,883 B2 2/2017 Dinh
9,596,898 B2 3/2017 Seawright
D783,899 S 4/2017 Roh
D783,901 S 4/2017 Kim et al.
D784,615 S 4/2017 Choi
9,622,527 B2 4/2017 Nguyen
D788,556 S 6/2017 James
9,730,481 B2 8/2017 Uresti
D796,582 S 9/2017 Beard
D800,966 S 10/2017 Silva
D805,135 S 12/2017 Beard
D806,315 S 12/2017 Hardwick
9,833,028 B2 12/2017 Jang et al.
9,848,661 B2 12/2017 Harris et al.
9,848,662 B2 12/2017 Dinh
D810,534 S 2/2018 Liu
D810,543 S 2/2018 Astradsson et al.
D811,872 S 3/2018 Wu
D814,107 S 3/2018 Lotti et al.
D814,260 S 4/2018 Dhubb
9,930,919 B1 4/2018 Branker et al.
D817,132 S 5/2018 Yang
9,993,373 B2 6/2018 Nassif et al.
D823,538 S 7/2018 Ruggaber
D823,683 S 7/2018 Caldwell
D825,333 S 8/2018 Ozamiz et al.
D828,013 S 9/2018 Van Wijngaarden et al.
D828,014 S 9/2018 Van Wijngaarden et al.
D828,629 S 9/2018 Hussain
D829,381 S 9/2018 Kim
D830,170 S 10/2018 Holmes
D832,701 S 11/2018 Oates
D832,702 S 11/2018 Oates
D835,465 S 12/2018 Son et al.
D836,432 S 12/2018 Riedel et al.
10,149,528 B2 12/2018 Erickson et al.
D836,943 S 1/2019 Klieman
D837,653 S 1/2019 Meranus
D840,104 S 2/2019 Hussain et al.
10,264,837 B2 4/2019 Park
D847,631 S 5/2019 Villbrandt
D847,632 S 5/2019 Villbrandt
D848,795 S 5/2019 Butler
D850,715 S 6/2019 Lotti
D852,412 S 6/2019 Grund et al.
10,362,823 B1 7/2019 Hill et al.
D863,419 S 10/2019 Oguma et al.
D863,679 S 10/2019 Lotti
10,433,607 B2 10/2019 Ahn
D867,664 S 11/2019 Lotti
D867,668 S 11/2019 Lotti
10,479,566 B2 11/2019 Doyle et al.
D871,673 S 12/2019 Qureshi et al.
10,532,861 B2 1/2020 Kimmel et al.
D877,416 S 3/2020 Lotti
10,660,388 B2 5/2020 Lotti
D890,430 S 7/2020 Lotti
10,721,984 B2 7/2020 Lotti
D895,201 S 9/2020 Lotti
D895,958 S 9/2020 Guo
10,791,782 B2 10/2020 Nakamura
D909,680 S 2/2021 Hussain
D914,965 S 3/2021 Lotti
D917,153 S 4/2021 Denei
D918,475 S 5/2021 Hu
D920,400 S 5/2021 Saito
D920,465 S 5/2021 Bould
D930,788 S 9/2021 Roth
D932,101 S 9/2021 Davis
11,219,260 B2 1/2022 Lotti
11,234,472 B2 2/2022 Lotti
11,253,020 B2 2/2022 Lotti
11,330,855 B2 5/2022 Lotti
11,330,856 B2 5/2022 Lotti
2001/0023699 A1 9/2001 Matthews
2001/0035192 A1 11/2001 Townsend
2001/0037813 A1 11/2001 Ra
2002/0056465 A1 5/2002 Shin
2002/0094507 A1 7/2002 Feuer
2002/0114657 A1 8/2002 Gueret
2002/0198597 A1 12/2002 Godfrey
2003/0005941 A1 1/2003 Iosilevich
2003/0111467 A1 6/2003 Norman et al.
2003/0155317 A1 8/2003 McNeeley et al.
2003/0226571 A1 12/2003 Rahman
2004/0011371 A1 1/2004 Harrison
2004/0011372 A1 1/2004 Park
2004/0079382 A1 4/2004 Profitt-Campbell
2004/0168696 A1 9/2004 Cox
2004/0211436 A1 10/2004 Knight
2005/0061341 A1 3/2005 Choe
2005/0098190 A1 5/2005 Kim
2005/0098191 A1 5/2005 Frazier
2005/0115581 A1 6/2005 Choi
2005/0166939 A1 8/2005 Stroud
2005/0194015 A1 9/2005 Watts
2005/0247326 A1 11/2005 Park
2005/0252517 A1 11/2005 Salinas
2005/0252518 A1 11/2005 Salinas
2006/0065280 A1 3/2006 Cheung
2006/0065281 A1 3/2006 Kim
2006/0081267 A1 4/2006 Kuptiz

(56) References Cited

U.S. PATENT DOCUMENTS

2006/0096609 A1 5/2006 Nwokola
2006/0124658 A1 6/2006 Coe et al.
2006/0129187 A1 6/2006 Cho
2006/0142693 A1 6/2006 Kahen
2006/0175853 A1 8/2006 Anderson et al.
2006/0180168 A1 8/2006 Dinnel
2006/0180171 A1 8/2006 Kim
2006/0266376 A1 11/2006 Basso
2007/0023062 A1 2/2007 McKinstry et al.
2007/0050207 A1 3/2007 Merszei
2007/0084749 A1 4/2007 Demelo et al.
2007/0157941 A1 7/2007 Awad et al.
2007/0157944 A1 7/2007 Catron et al.
2007/0199571 A1 8/2007 McCulloch
2007/0221240 A1 9/2007 Junsuh Lee
2007/0227550 A1 10/2007 Merszei
2007/0272263 A1 11/2007 Gold
2007/0272264 A1 11/2007 Byrne
2007/0295353 A1 12/2007 Dinh
2008/0017210 A1 1/2008 Eaton
2008/0196732 A1 8/2008 Merszei
2008/0223390 A1 9/2008 Brown
2008/0276949 A1 11/2008 Lee
2008/0283072 A1 11/2008 Sun
2009/0014023 A1 1/2009 Waters
2009/0026676 A1 1/2009 Kurita et al.
2009/0028625 A1 1/2009 Bonneyrat
2009/0071490 A1 3/2009 Sthair
2009/0071492 A1 3/2009 Oh
2009/0178689 A1 7/2009 Navarro et al.
2009/0217936 A1 9/2009 Sato et al.
2009/0217939 A1 9/2009 Rabe et al.
2009/0223534 A1 9/2009 Green
2009/0241973 A1 10/2009 Hampton
2009/0241979 A1 10/2009 Navarro et al.
2009/0255547 A1 10/2009 Starks et al.
2009/0266373 A1 10/2009 Kupitz
2009/0266376 A1 10/2009 Beschta
2010/0043816 A1 2/2010 Dix
2010/0065078 A1 3/2010 Reece
2010/0070526 A1 3/2010 Matias
2010/0127228 A1 5/2010 Xie et al.
2010/0170526 A1 7/2010 Nguyen
2011/0079233 A1 4/2011 Cheh
2011/0079235 A1 4/2011 Reed
2011/0079236 A1 4/2011 Lee
2011/0121592 A1 5/2011 Cho
2011/0127228 A1 6/2011 Sagel
2011/0220136 A1 9/2011 Kang
2011/0226274 A1 9/2011 Turner
2011/0240049 A1 10/2011 Kim et al.
2011/0278869 A1 11/2011 Lee et al.
2011/0290271 A1 12/2011 Rabe et al.
2011/0290937 A1 12/2011 Salkeld
2012/0037177 A1 2/2012 Teater Makinen
2012/0055499 A1 3/2012 Sanbonmatsu
2012/0160259 A1 6/2012 Nguyen et al.
2012/0174939 A1 7/2012 Starks et al.
2012/0180804 A1 7/2012 Hochi et al.
2012/0266903 A1 10/2012 Devlin
2012/0305020 A1 12/2012 Byrne
2012/0318290 A1 12/2012 Kim
2013/0019889 A1 1/2013 Palmer-Rogers
2013/0032162 A1 2/2013 Major
2013/0042881 A1 2/2013 Mutchler
2013/0042884 A1 2/2013 Wilkinson
2013/0110032 A1 5/2013 Luzon et al.
2013/0160783 A1 6/2013 Ahn et al.
2013/0167855 A1 7/2013 Kupitz
2013/0167858 A1 7/2013 Lee
2013/0255706 A1 10/2013 Dinh
2013/0276807 A1 10/2013 Teater Makinen
2013/0298931 A1 11/2013 Samain et al.
2013/0306089 A1 11/2013 Araujo Costa
2013/0306094 A1 11/2013 West
2013/0312781 A1 11/2013 Murphy
2013/0312782 A1 11/2013 Kindall
2013/0320025 A1 12/2013 Mazzetta et al.
2013/0333714 A1 12/2013 Merszei
2014/0011372 A1 1/2014 Kato et al.
2014/0060559 A1 3/2014 Lin
2014/0069451 A1 3/2014 Hwang
2014/0083447 A1 3/2014 Rabe et al.
2014/0110304 A1 4/2014 Wu et al.
2014/0116456 A1 5/2014 Palmer-Rogers
2014/0135914 A1 5/2014 Conant
2014/0216488 A1 8/2014 Dinh
2014/0332025 A1 11/2014 Kim et al.
2015/0020840 A1 1/2015 Rabe et al.
2015/0075549 A1 3/2015 Lee et al.
2015/0114421 A1 4/2015 Pham
2015/0114422 A1 4/2015 Abraham et al.
2015/0114423 A1 4/2015 Sanbonmatsu
2015/0128986 A1 5/2015 Stookey
2015/0136162 A1 5/2015 Brouillet et al.
2015/0173442 A1 6/2015 Raouf
2015/0181967 A1 7/2015 Dinh
2015/0201691 A1 7/2015 Palmer-Rogers
2015/0201692 A1 7/2015 Hansen et al.
2015/0216246 A1 8/2015 Ahn et al.
2016/0016702 A1 1/2016 Siskindovich et al.
2016/0037847 A1 2/2016 Tavakoli
2016/0037848 A1 2/2016 Lee
2016/0050996 A1 2/2016 Kwon
2016/0058088 A1 3/2016 Le
2016/0088889 A1 3/2016 Kettavong
2016/0135531 A1 5/2016 Ezechukwu
2016/0174645 A1 6/2016 Goldner
2016/0192724 A1 7/2016 Scott et al.
2016/0192725 A1 7/2016 Merszei
2016/0206031 A1 7/2016 Stoka
2016/0219959 A1 8/2016 Chipman et al.
2016/0286881 A1 10/2016 Ko
2016/0324241 A2 11/2016 Lee
2016/0324242 A1 11/2016 Hansen et al.
2016/0345648 A1 12/2016 Miniello et al.
2016/0353821 A1 12/2016 Calina
2017/0000204 A1 1/2017 Wibowo
2017/0006947 A1 1/2017 Uresti
2017/0020219 A1 1/2017 Beschta
2017/0049172 A1 2/2017 Ahn
2017/0049173 A1 2/2017 Dinh
2017/0055615 A1 3/2017 Crocilla
2017/0079356 A1 3/2017 Dinh
2017/0079357 A1 3/2017 Dinh
2017/0079358 A1 3/2017 Dinh
2017/0112214 A1 4/2017 Ahn
2017/0112215 A1 4/2017 Dinh
2017/0112264 A1 4/2017 Park
2017/0127743 A1 5/2017 Nakamura et al.
2017/0150763 A1 6/2017 Schroeder
2017/0208885 A1 7/2017 Alex
2017/0231309 A1 8/2017 Han
2017/0258163 A1 9/2017 Uresti
2017/0265550 A1 9/2017 Han et al.
2017/0311667 A1 11/2017 Passariello et al.
2017/0340041 A1 11/2017 Nguyen
2017/0347731 A1 12/2017 Chipman et al.
2017/0358245 A1 12/2017 Dana
2017/0360134 A1 12/2017 Crocilla
2017/0360135 A1 12/2017 Ahn
2017/0360136 A1 12/2017 Ferrier et al.
2018/0065779 A1 3/2018 Chiba
2018/0098591 A1 4/2018 Leeflang
2018/0160755 A1 6/2018 Hansen et al.
2018/0235299 A1 8/2018 Stoka
2018/0242671 A1 8/2018 Merszei
2018/0242672 A1 8/2018 Lotti
2018/0242715 A1 8/2018 Lotti
2018/0352885 A1 12/2018 Kim
2018/0352886 A1 12/2018 Schroeder et al.
2019/0133227 A1 5/2019 Le
2019/0191851 A1 6/2019 Esposito et al.
2019/0254373 A1 8/2019 Kim

(56) References Cited

U.S. PATENT DOCUMENTS

| | | | |
|---|---|---|---|
| 2019/0254374 | A1 | 8/2019 | Schroeder |
| 2020/0093211 | A1 | 3/2020 | Lee |
| 2020/0260839 | A1 | 8/2020 | Lotti |
| 2021/0030140 | A1 | 2/2021 | Chico |

FOREIGN PATENT DOCUMENTS

| | | | |
|---|---|---|---|
| GB | 190218723 | A | 11/1902 |
| GB | 1021063 | A | 2/1966 |
| GB | 1272616 | A | 5/1972 |
| GB | 1307107 | A | 2/1973 |
| GB | 2450250 | * | 12/2008 |
| JP | 2009040718 | A | 2/2009 |
| JP | 2011500979 | A | 1/2011 |
| JP | 2011122288 | A | 6/2011 |
| JP | 2011177395 | A | 9/2011 |
| JP | 2015105447 | A | 6/2015 |
| JP | 3201846 | U | 1/2016 |
| JP | 2016027220 | A | 2/2016 |
| JP | 2016163699 | A | 9/2016 |
| JP | 2019522125 | A | 8/2019 |
| KR | 200165452 | Y1 | 2/2000 |
| KR | 200395554 | Y1 | 9/2005 |
| KR | 20060010717 | A | 2/2006 |
| KR | 20090010717 | A | 1/2009 |
| KR | 101336422 | B1 | 12/2013 |
| KR | 20150140672 | A | 12/2015 |
| KR | 20190035787 | A | 4/2019 |
| RU | 2558482 | C1 | 8/2015 |
| TW | 430199 | | 9/2011 |
| WO | 2014163364 | A1 | 10/2014 |
| WO | 2018022914 | A1 | 2/2018 |
| WO | 2018119034 | A1 | 6/2018 |

OTHER PUBLICATIONS

"Qingdao Hongfutian Eyelash Co., Ltd., YouTube (Oct. 13, 2016),https://www.youtube.com/watch?v=rlnKgJJm7-0".
Goodyard eyelash production process, YouTube (Nov. 2, 2016), https://www.youtube.com/watch?v=FlxGtTPNALo.
"How To Apply False Eyelashes For Beginners ♡ Two Easy Ways, YouTube (Sep. 6, 2013),https://www.youtube.com/watch?v=79oSI7fNzOE".
"In Depth Tutorial: Ardell Lashtite Glue | Apply Under My Natural Lashes!, YouTube (Feb. 24, 2015),https://www.youtube.com/watch?v=comq0clt560".
"How False Eyelashes Are Made!!, Youtube (Nov. 29, 2015),https://www.youtube.com/watch?v=hqsx0kthwqg".
"♡ All About Eyelash Extensions! ♡ FAQ's & Application FAQ'S SaturdayNightsAlrite, YouTube (Feb. 24, 2013), https://www.youtube.com/watch?v=MTL70W58I9I".
"How to apply Cluster/Party Lashes 2, YouTube (Feb. 12, 2014),https://www.youtube.com/watch?v=faKvACCAvNU".
"Applying Falsies Underneath Lash!, YouTube (Sep. 24, 2016),https://www.youtube.com/watch?v=6VopJnVWv8s&feature=youtu.be".
"How To Apply Individual Lashes ft. Ardell Individuals | Melissa Alatorre, YouTube (Sep. 4, 2015),https://www.youtube.com/watch?v=c2iqLwjryWM".
"How to Apply Individual Lashes, YouTube (Mar. 16, 2013),https://www.youtube.com/watch?v=aLHE2SqzlO8".
"Lisa Eldridge—How To Apply Individual False Eyelashes Tutorial, YouTube (Mar. 17, 2010),https://www.youtube.com/watch?v=IKO10VdtLFU".
"How To: Apply Individual False Lashes—Lashes Love & Leather, YouTube (Jan. 28, 2016),https://www.youtube.com/watch?v=nLMz-lauMkl".
"Dream Lashes Curved Volume Tweezer—3 Minute Test, https://www.youtube.com/watch?vwgYeE0SD7s".
Overview of materials for Polybutylene Terephthalate (PBT), Unreinforced, Molded, https://www.matweb.com/search/datasheet_print.aspx?matguid=781bd0e9d0854fd5a919866c39ea3065.
"How to Master Individual Fake Eyelashes | NewBeauty Tips & Tutorials, YouTube (Aug. 21, 2015),https://www.youtube.com/watch?v=ObItZN1NsB0&t=44s".
"Introducing Kiss EverEZ Trio Lashes., YouTube (May 10, 2013),https://www.youtube.com/watch?v=37z4VMQ7Yxc".
"Review | New Kiss iEnvy EZ Lashes Trio Lashes—Easier than Individual Lashes!, YouTube (Mar. 10, 2021),https://www.youtube.com/watch?v=BS9G6jgDgOA".
"How To Apply False Lashes Under Your Lashes | Reverse Eyelash Trick Makeup Hack, YouTube (Oct. 3, 2016), https://www.youtube.com/watch?v=BCq4xCQrQHE".
"How To Fake Eyelash Extensions: Reviewing Kiss Ever EZ Lashes, YouTube (Mar. 22, 2015),https://www.youtube.com/watch?v=AhJyTcClaMs".
"Reverse Eyelash Tutorial Irisbeilin, YouTube (Sep. 13, 2016),https://www.youtube.com/watch?v=q1Cu0p6bqHs".
"Reverse Eyelash Trick |Makeup Hack, YouTube (Sep. 18, 2016),https://www.youtube.com/watch?v=FQFF1sOQbCI".
"Crazy False Eyelash Hack for Natural/Comfortable Lashes !!! | WTF!!!!! , YouTube (Feb. 2, 2017), https://www.youtube.com/watch?v=99rHNYe3GFw".
"Reverse Eyelash Hack | Does it work?, YouTube (Oct. 12, 2016), https://www.youtube.com/watch?v=sx_X89xdBbE".
"Applying Falsies Under Lash?? Does it work??!!, YouTube (Sep. 27, 2016),https://www.youtube.com/watch?v=5kytWJ0Qbg".
"Applying Falsies Underneath / Reverse Best Lash Hack, YouTube (Sep. 22, 2016),https://www.youtube.com/watch?v=GhG5hoMh000".
"How To Apply False Lashes . . . Underneath!?, YouTube (Jan. 13, 2017),https://www.youtube.com/watch?v=mlkvFgb8PmA".
"Applying Falsies Underneath Lash!, YouTube (Sep. 24, 2016), https://www.youtube.com/watch?v=6VopJnVWv8s&t=13s".
"False Lashes Tips And Tricks For Beginners! | The how to guide for Lashes, YouTube (Jan. 27, 2017),https://www.youtube.com/watch?v=BaQO8g4iUxY".
"Applying Falsies Under Lash?! Does It Work?, YouTube (Sep. 14, 2016),https://www.youtube.com/watch?v=V96EKKAe03c".
"How to apply individual lashes, YouTube (Apr. 5, 2010), https://www.youtube.com/watch?v=9X84CUIWqgo".
"Lux Beauty Lashes—Process of making false eyelash product, YouTube (Dec. 12, 2015),https://www.youtube.com/watch?v=515QCxnjrkQ".
"The Best Way to Apply False Lashes | Cosmopolitan, YouTube (Apr. 1, 2016),https://www.youtube.com/watch?v=40yZu-4KZs8".
"Applying False Lashes Underneath Your Own Top Eye Lashes | Best Beauty Tip/Hack Ever!, YouTube (July 2, (2016), https://www.youtube.com/watch?v=FzEtZgY-5Y8".
"Your guide to Russian Volume Lash Extensions, https://www.bllashes.com/blogs/blog/your-guide-to-the-must-have-tools-for-russian-volume-lashesretrieved Mar. 29, 2023".
"Process of Making Mellow Eyelashes, YouTube (Nov. 13, 2015),https://www.youtube.com/watch?v =-VlhGQX58HM&t=2s".
"How To Apply False Eyelashes For Beginners ♡ Two Easy Ways, Youtube (Sep. 6, 2013),https://www.youtube.com/watch?app=desktop&v=79oSI7fNzOE".
"How to apply iENVY Quattro collection eyelashes, Youtube (Aug. 18, 2015),https://www.youtube.com/watch?v=kWovIGoCmc".
"Learn How to Apply Trio Lashes!, Youtube ( Feb. 20, 2015),https://www.youtube.com/watch?v=bx6PXgZMvhg".
"Why 'tightlining' is the makeup trick you need to try (May 6, 2016),https://www.getthegloss.com/beauty/makeup/why-tightlining-is-the-makeuptrick-you-need-to-try".
"The Small Things, How to fake a thicker lash line, May 17, 2017https://www.thesmallthingsblog.com/2016/05/how-to-fake-a-thicker-lash-line/#:~:text=Pick%20up%20a%20gel%20or,of%20a%20thicker%20lash%20line."
"GladGirl, Glad Lash Flare Cluster Lash Application (see, e.g. ,https://www.youtube.com/watch?v=JU_ZcY95nVo&t=23s)".
Rosato, Marlene G., and Dominick V. Rosato. Concise encyclopedia of plastics. pp. 39-52, Springer Science & Business Media, 2012.
Palin, George Richard. Plastics for Engineers: An Introductory Course. Elsevier, 1967. pp. 125-139.

(56) References Cited

OTHER PUBLICATIONS

Ebnesajjad S, Landrock AH. Adhesives technology handbook. William Andrew; Nov. 26, 2014. pp. 67-83.
Artificial Eyelashes (1949), https://www.youtube.com/watch?v=8Fv7EzDvo58, published Apr. 13, 2014.
Silmy's Eyelashes, Youtube (Dec. 2, 2011), https://www.youtube.com/watch?v=I_rg1ybHUwY.
D'Eyeko—Olga Lydia Factory Visit, Youtube (Jun. 24, 2013), https://www.youtube.com/watch?v=Q5ZLklqkEtY.

* cited by examiner

STACKING ARTIFICIAL LASH EXTENSIONS

CROSS-REFERENCE TO RELATED APPLICATIONS

This application is a divisional of U.S. application Ser. No. 17/061,192, filed Oct. 1, 2020, which claims the benefit and priority of U.S. Provisional Application No. 62/909,904, filed Oct. 3, 2019, which are both hereby incorporated by reference in its entirety herein.

FIELD OF THE INVENTION

Various embodiments concern artificial eyelashes and, more specifically, artificial eyelash extensions that can be applied to the underside of an individual's natural eyelashes.

BACKGROUND

False eyelash extensions have conventionally been used to enhance the length, thickness, and fullness of natural eyelashes. False eyelash extensions, however, must be applied to an individual's natural eyelashes one by one to avoid having the eyelash extensions stick together. Consequently, false lash extension services can cost hundreds of dollars depending on the type and number of lashes used, the skill of the cosmetician, and the venue where the false eyelash extensions are applied. It usually takes an experienced cosmetician one to two hours to attach a full set of false eyelash extensions.

Alternatively, false eyelashes may be applied directly to an individual's eyelid. False eyelashes come in strips (and thus may also be referred to as "strip lashes") that can be trimmed to fit the width of the individual's eyelid. While a strip of false eyelashes can be applied in a single motion, false eyelashes are easily distinguishable from the individual's natural eyelashes and may be uncomfortable when worn for extended periods of time.

SUMMARY

Some of the embodiments described include an artificial lash extension system comprising a first plurality of lash extensions designed for an application at an underside of a natural lash, each of the first plurality of lash extensions comprising: a first plurality of artificial hairs, and a first base from which the first artificial hairs protrude, wherein the first base comprises a top side designed to attach to the underside of the natural lash; and a second plurality of lash extensions designed for an application under the first plurality of lashes, each of the second plurality of lash extensions comprising: a second plurality of artificial hairs, and a second base from which the second artificial hairs protrude, wherein the second base comprises a top side designed to attach to at least part of a bottom side of one or more of the first plurality of lash extensions.

Some of the embodiments described include an artificial lash extension system, comprising: a container; and a first plurality and a second plurality of lash extensions releasably coupled to the container, the first plurality of lash extensions designed for an application at an underside of a natural lash, each of the first plurality of lash extensions comprising: a first plurality of artificial hairs, and a first base from which the first artificial hairs protrude, wherein the first base comprises a top side designed to attach to the underside of the natural lash; and the second plurality of lash extensions designed for an application under the first plurality of lashes, each of the second plurality of lash extensions comprising: a second plurality of artificial hairs, and a second base from which the second artificial hairs protrude, wherein the second base comprises a top side designed to attach to at least part of a bottom side of one or more of the first plurality of lash extensions.

Some of the embodiments described include a method comprising applying adhesive to an underside of a natural lash; arranging a first plurality of lash extensions at the underside of the natural lash, wherein each of the first plurality of lash extensions comprise a first plurality of artificial hairs and a first base from which the first artificial hairs protrude, wherein the first base comprises a top side designed to attach to the underside of the natural lash; applying adhesive to bottom sides of the first plurality of lash extensions; and arranging a second plurality of lash extensions at the bottom sides of the first plurality of lash extensions, wherein each of the second plurality of lash extensions comprise a second plurality of artificial hairs and a second base from which the second artificial hairs protrude, wherein the second base comprises a top side designed to attach to a bottom side of one or more of the first plurality of lash extensions.

Some of the embodiments described include the artificial lash extension system wherein bottom sides of the first bases and the top sides of the second bases are substantially flat to facilitate the attachment of the second plurality of lash extensions to the first plurality of lash extensions.

Some of the embodiments described include the artificial lash extension wherein the first plurality of lash extensions comprise a first lash extension and the second plurality of lash extensions comprise a second lash extension, wherein the second lash extension is attachable to the first lash extension in an offset arrangement where a backside of the second base of the second lash extension is offset from a front side of the first base of the first lash extension.

Some of the embodiments described include the artificial lash extension wherein a second lash extension of the second plurality of lash extensions is attachable to a first lash extension of the first plurality of lash extensions in a staggered arrangement.

Some of the embodiments described include the artificial lash extension wherein a second lash extension of the second plurality of lash extensions is attachable to a first lash extension of the first plurality of lash extensions in an aligned stack arrangement.

Some of the embodiments described include the artificial lash extension wherein at least one of the first plurality of lash extensions and at least one of the second plurality of lash extensions is at least one of a different length, different style, different color, or comprise a different number of artificial hairs.

Some of the embodiments described include the artificial lash extension wherein a first plurality of artificial hairs and the second plurality of artificial hairs comprise polybutylene terephthalate.

BRIEF DESCRIPTION OF THE DRAWINGS

The disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

The figures depict various embodiments for the purpose of illustration only. Those skilled in the art will readily recognize that alternative embodiments may be employed without departing from the principles of the present invention. The claimed subject matter is intended to cover all modifications, equivalents, and alternatives falling within the scope of the present invention as defined by the appended claims.

DETAILED DESCRIPTION

Embodiments described herein are related to systems and methods for arranging multiple sets (or rows) of artificial lash extension segments to the underside of upper natural lashes (also referred to as "stacked lashes" herein).

False eyelashes are applied directly to an individual's eyelid. This is because false eyelashes are too heavy, too wide and/or too bulky to adhere to the underside of a natural lash. As such, false eyelashes are unable to be stacked on one another to form a fuller false lash at the underside of the natural lash. Aspects of the disclosure address these and other challenges by providing an artificial lash extension capable of being arranged and affixed, in multiple sets, to the underside of upper natural lashes.

In some embodiments, lash extensions may be designed for application at an underside of a natural lash. Each of the lash extensions may include artificial hairs protruding from a base designed to attach to the underside of the natural lash or to another artificial lash extension. The base may include a low profile designed to allow the artificial lash extension to be lightweight so as to better adhere to the underside of the natural lash and prevent obstruction of a user's view. The base may include a top side and a bottom side that are substantially flat to improve contact and adhesion to a surface, such as the underside of a natural lash or the opposing surface of another artificial lash extension. The low profile of the base and the flatness of the base can at least in part be attributed to an application of heat in the formation of the base. In some embodiments, a first set of lash extensions may be affixed at an underside of a natural lash. A second set of lash extensions may be affixed under the first set of lashes (e.g. stacked lashes). In relation to the first set, the second set may be arranged in one or more different patterns, such as a staggered pattern arrangement, an aligned arrangement, a longitudinally offset arrangement, or any combination thereof. Additional sets of lash extensions may be affixed to preceding sets of lash extensions. By providing a system that enables the arranging of multiple lightweight sets of lash extension to the underside of upper natural lashes, a desired lash density or volume is achieved without tiring the user's eyelids.

Figure 1:
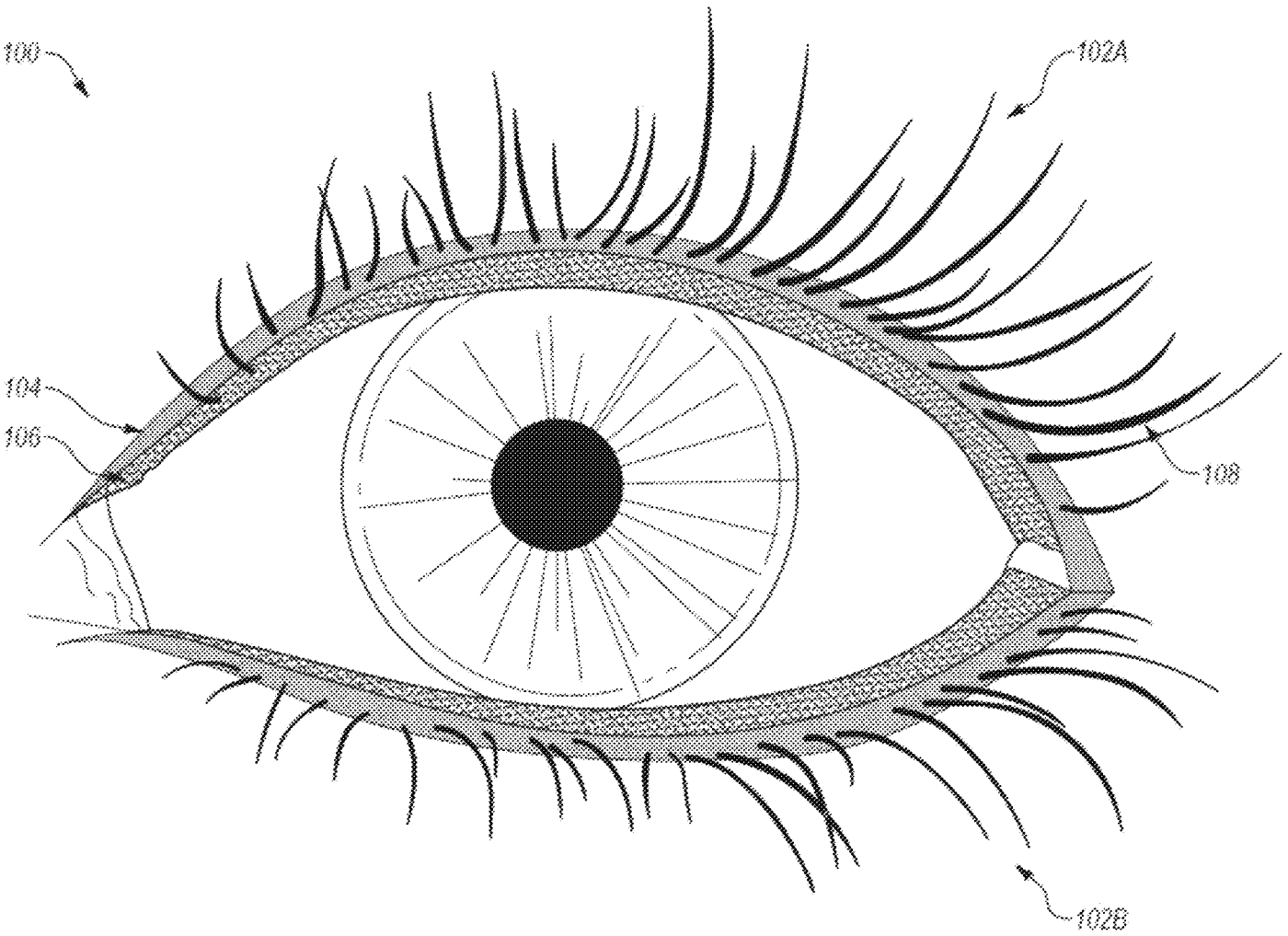
FIG. 1 is an illustration of an eye area, in accordance with some embodiments of the disclosure.

FIG. 1 is an illustration of an eye area, in accordance with some embodiments of the disclosure. As shown in FIG. 1, the eye area 100, such as a human eye area, can include upper natural lashes 102A (also referred to as "natural lashes 102A" or "natural lash 102A" herein) and lower natural lashes 102B (also referred to as "natural lashes 102B" or "natural lash 102B" herein). Natural lashes 102A and 102B can have an underside and topside. For example, natural lashes 102A show an underside 108. Natural lashes 102B show a topside. Natural lashes 102A and 102B are collectively referred to as natural lashes 102, herein.

The eye area 100 includes an upper lash line 104 (also referred to as "lash line 104" herein) and upper waterline 106 (also referred to as "waterline 106" herein). In some embodiments, a lash line, such as the upper lash line 104 or lower lash line of natural lashes 102B, can include the area between the natural lashes. The lash line can be curved and follow the alignment of the natural lashes 102. In some embodiments, the upper lash line 104 can include some area of the skin that is above (e.g., directly above) the natural lashes 102A. Similarly, the lower lash line can include some are of the skin that is below (e.g., directly below) the natural lashes 102B.

In some embodiments, the waterline (also referred to as "wetline"), such as upper water line 106 and lower water line corresponding to natural lashes 102B, can include an area (or line) of skin that is exposed between the natural lashes 102 and the eye.

Spatially relative terms, such as "under," "upper" "lower," "top," "bottom," and so forth as used herein refer to a relative position of one element with respect to another element. Unless otherwise specified, the spatially relative terms are not intended to be limiting to the absolute orientation, and are intended to encompass different orientations (e.g., rotated 90 degrees, inverted, flipped) of elements in addition to the orientation depicted in the Figures. For example, if elements in the Figures are inverted, elements described as "upper" elements can then be considered oriented as "lower" elements, without deviating from aspects of the disclosure.

Figure 2:
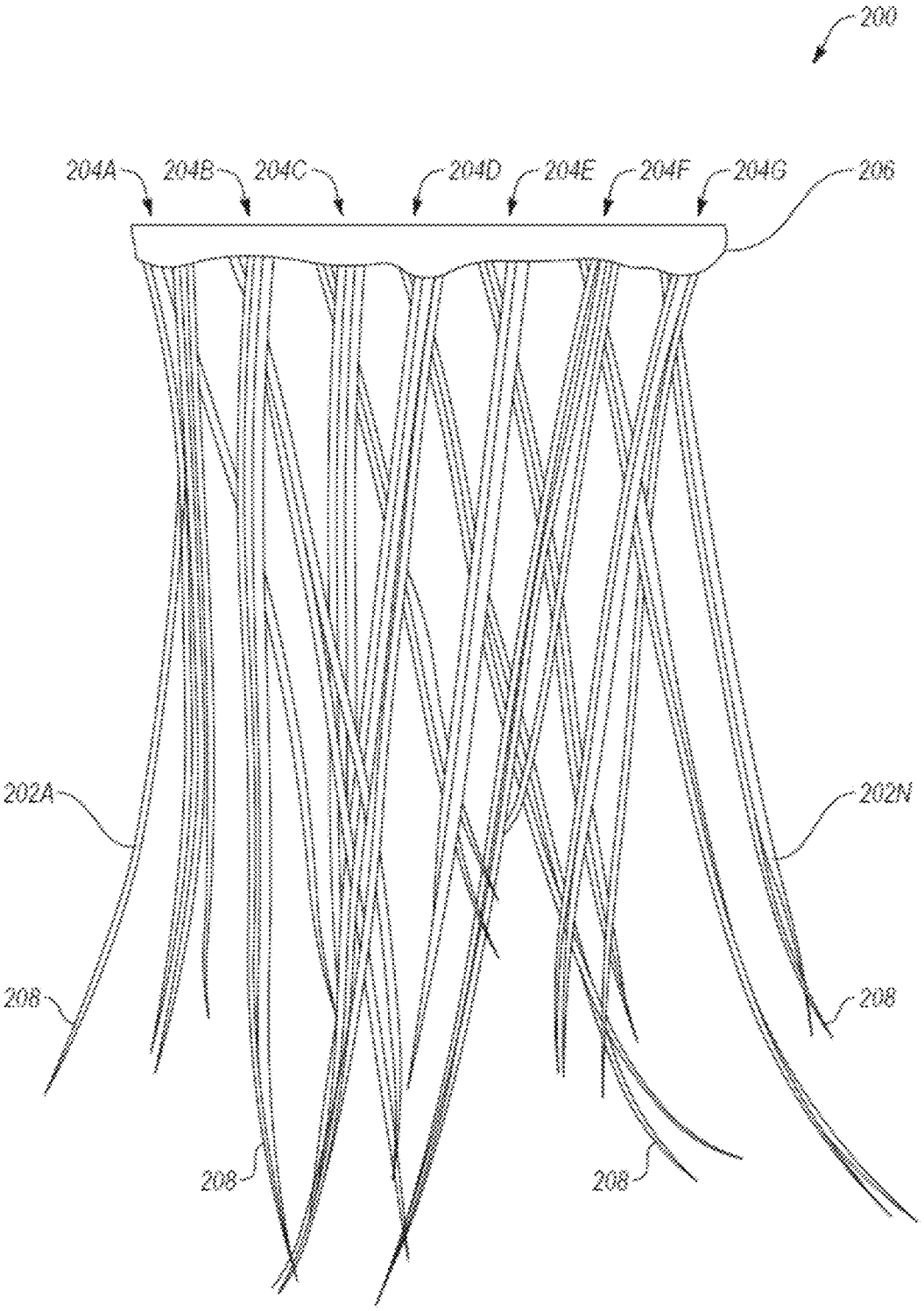
FIG. 2 is an illustration of an exemplary artificial lash extension, in accordance with some embodiments of the disclosure.
Figure 3:
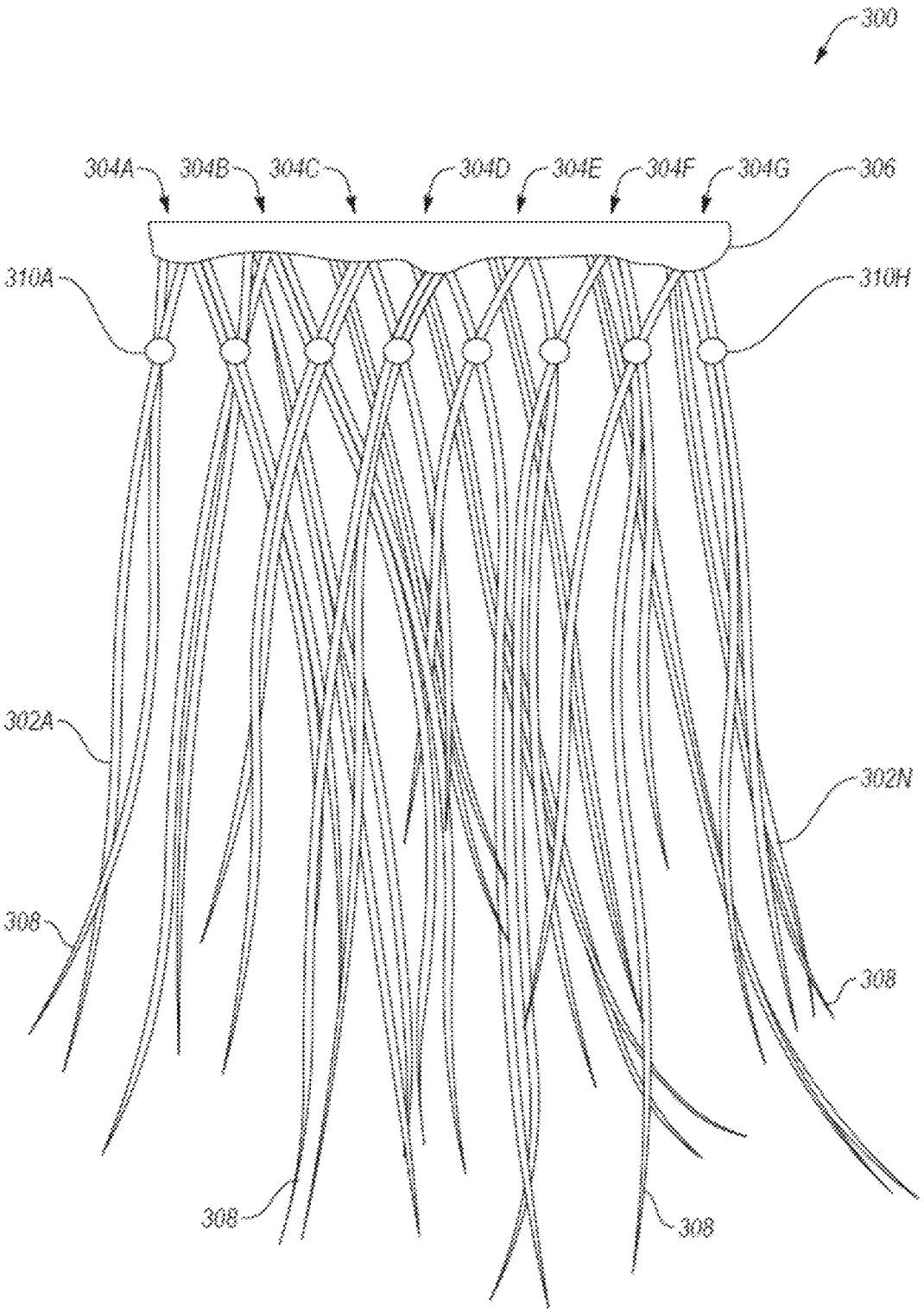
FIG. 3 is an illustration of another exemplary artificial lash extension, in accordance with some embodiments of the disclosure.

FIG. 2 is an illustration of an exemplary artificial lash extension, in accordance with some embodiments of the disclosure. FIG. 3 is an illustration of another exemplary artificial lash extension, in accordance with some embodiments of the disclosure.

In some embodiments, one or more of artificial lash extension 200 or artificial lash extension 300 (both also referred to as "lash extension," "artificial eyelash extension," "lash segment" or "artificial lash segment" herein) are designed or configured for application at the underside of a natural lash. In some embodiments, one or more of artificial lash extension 200 or artificial lash extension 300 can be part of a set of multiple artificial lash extensions. In some embodiments, one or more of artificial lash extension 200 or artificial lash extension 200 can be a segment of a "full" artificial lash extension such that when multiple artificial lash extensions are arranged adjacent to one another at the underside of a natural lash (e.g., natural lashes 102A) the arranged artificial lash extensions span the length of the natural lash. The artificial lash extension can be arranged to substantially align with the lash line of the user. Using artificial lash extensions that are independent segments can allow an individual artificial lash extension to move independently when bonded to the underside of a natural lash, which mimics the movement of the natural lash and can improve the feel, comfort, and longevity of the artificial lash extensions.

Artificial lash extension 200 and artificial lash extension 300 respectively depict artificial hairs 202A-202N (collectively referred to as "artificial hairs 202" herein) and 302A-302N (collectively referred to as "artificial hairs 303" herein). In some embodiments, the artificial hairs of an artificial lash extension, such as artificial lash extension 200 or artificial lash extension 300, can be formed from one or more synthetic materials, including but not limited to polybutylene terephthalate (PBT), acrylic resin, polyester, or other synthetic material. In alternative embodiments, a natural material such as natural hair (e.g., human hair or mink hair) can be used. In some embodiments, the artificial hairs of a particular artificial lash extension can have one or more lengths and/or one or more diameters. In some embodiments, the diameter of an artificial hair can be between approximately 0.0075 millimeters (mm) (e.g., 0.0075 mm+/−0.0025 mm) to 0.3 mm (e.g., 0.3 mm+/−0.05 mm). In some embodiments, the ends of one or more of the artificial hairs can be tapered. In some embodiments, the one or more of artificial hairs can be curled or shaped in particular direction. For example, the ends 208 of artificial hairs 202 or the ends 308 of artificial hairs 302 can be tapered or curled or both. In some embodiments, the artificial hairs can range from 3 mm to 30 mm in length or in some instances even longer.

In some embodiments, one or more of artificial lash extension 200 or artificial lash extension 300 can include a base, such as base 206 and base 306, respectively. The base can include a top side (e.g., facing out of the page and towards the reader), a bottom side, a back side, a front side, and two lateral sides. In some embodiments, one or more of the multiple artificial hairs of artificial lash extension protrude out the front side of the base. When arranged at the underside of a natural lash, the backside of the artificial lash extension can point towards the user's eye. The thickness (e.g., between the topside and bottom side of the base can be between approximately 0.05 millimeters (mm) and approximately 0.15 mm (e.g., 0.05 mm+/−0.01 mm). The low profile of the base is designed to allow the artificial lash extension to be light weight so as to better adhere to the underside of the natural lash and prevent obstruction of a user's view. The low profile of the base can at least in part be attributed to an application of heat in the formation of the base.

In some embodiments, one or more of the top side or bottom side (e.g., surface) of the base is substantially flat (e.g., having a flatness control tolerance value of +/−0.03 mm or +/−0.015 mm). In some embodiments, the flatness of the base of the artificial lash extension 200 is designed to allow improved contact and adhesion to a surface, such as the underside of a natural lash or the opposing surface of another artificial lash extension. The flatness of the base can at least in part be attributed to an application of heat in the formation of the base.

In some embodiments, the base can be formed by an application of heat at or near the area of the base to be formed. The application of heat can cause one or more of the artificial hairs (e.g. all of the artificial hairs) of an artificial lash extension to be connected to the base. In some embodiments, a heated fixture, such a heated platen, a heated crimp, heating lamp or other device can be used (e.g., pressed against the artificial hairs) to at least partially melt at least some of the artificial hairs. In some embodiments, the at least partially melted artificial hairs at least in part, or in full, form the base. In some embodiments, the at least partially melted artificial hairs melt in manner that connects the multiple artificial hairs to the base of the artificial lash extension.

In some embodiments, some additional artificial material, such as one or more artificial hairs or other material can be placed orthogonal to the artificial hairs at the area where the base is to be formed. Heat can be applied to the area of where the base is to be formed (which includes the additional artificial material). One or more of the artificial hairs or the additional artificial material can at least partially melt to at least in part, or in full, form the base. In some embodiments, the additional artificial material can include an adhesive (e.g. application of adhesive) and/or support thread. In some embodiments, the application of heat can be used to help cure the applied adhesive. In some embodiments that use an adhesive with the application of heat may or may not partially melt the artificial hairs.

In some embodiments, prior to the application of heat the artificial hairs may be tied (e.g., knotted) to a support or base thread or fiber to align the artificial hairs and prevent the horizontal spreading of the artificial hairs. Heat can be applied as described above (while the artificial hairs are knotted to a support thread) such that the support thread forms part of the base. In other instances, heat can be applied below the horizontal support thread. For instance, the support thread can hold the artificial hairs in place and the application heat can form a base below the support thread. In other embodiments, the artificial hairs are not aligned with a support thread (e.g., are not knotted on a support thread) before or during the formation of the base using the application of heat. In other embodiments, the artificial hairs can be arranged using a stencil or other arrangement device before or during the formation of the base using the application of heat. In some embodiments, one or more applications of heat can be performed to form the base. In an alternative embodiment, the base can be formed in part or in full using a chemical process.

In some embodiments, one or more of artificial lash extension 200 and artificial lash extension 300 include artificial hairs 202 and 302 that are respectively configured into clusters 204A-204G (collectively referred to as "clusters 204" herein) and 304A-304G (collectively referred to as "clusters 304" herein). In some embodiments, a cluster of hairs can refer to two or more artificial hairs that are grouped together. In some embodiments, 3-30 artificial hairs can be included in a cluster. In some embodiments, one or more individual clusters of artificial hairs can be formed using an application of heat as described above. Thus, the clusters can have a base (e.g., cluster base). The clusters can be arranged and heat can be applied, as described above, to the cluster bases to form another base (e.g., artificial lash extension base). In some embodiments, the artificial lash extension is formed without creating clusters using the application of heat. In some embodiments, at least two artificial hairs of an artificial lash extension crisscross each other. For example, two artificial hairs of a particular cluster can crisscross one another.

In some embodiments, artificial lash extensions 200 or 300 may be 4-10 mm wide, though embodiments may be 5-6 mm wide. In some embodiments, this is much wider than single clusters that are typically 1.5-2 mm wide, and thus provide greater coverage of the natural lash.

Artificial lash extension 300 further illustrates adjacent artificial hairs (or adjacent clusters 304) that are coupled or secured to one another at intersecting portions 310A-310H (collectively referred to as "intersecting portions 310" herein) of the crisscrossing artificial hairs 302. The intersecting portions 310 can be coupled or secured to one another using one or more of an application of heat, an application of adhesive, or a chemical process as described herein. In some embodiments, the intersecting portions 310 can be formed after or during the formation of the base. For example, the crisscrossing artificial hairs 302 are connected or secured together approximately 1 mm to approximately 5 mm (+/−0.5 mm) above the base 306. In some embodiments, the base 306 can be removed after the formation of the intersecting portions 310, such that the artificial lash extension 300 does not include the base 306. The secured intersecting portions 310 can hold artificial hairs 302 of the artificial lash extension 300 together in the absence of base 306. In some embodiments, base 306 in not formed. The intersecting portions 310 of the crisscrossing artificial hairs 302 can be formed without forming a base 306.

Figure 4:
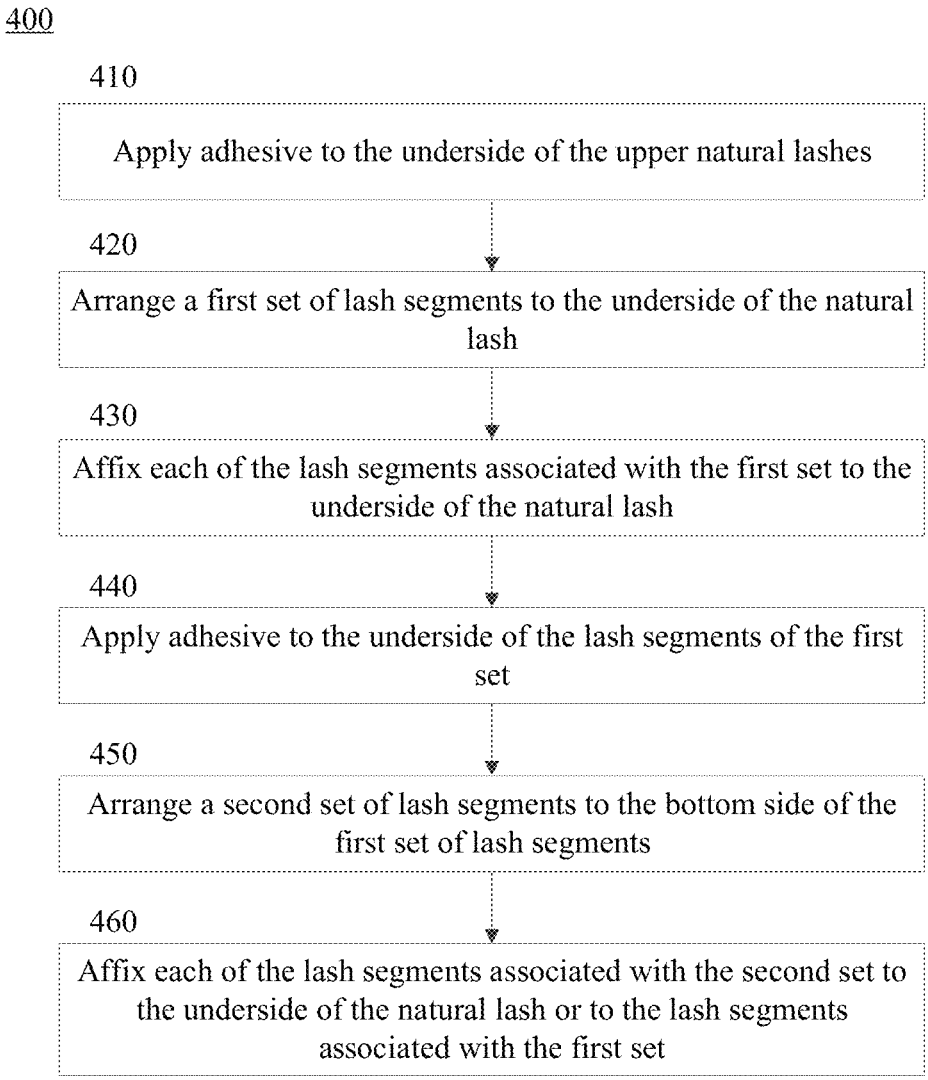
FIG. 4 depicts a flow diagram of a flow diagram of an illustrative example of a method for arranging multiple sets of artificial lash extensions to the underside of upper natural lashes, in accordance with embodiments of the disclosure.

FIG. 4 depicts a flow diagram of an illustrative example of a method 400 for arranging multiple sets (or rows) of artificial lash extensions (e.g., where an artificial lash extension is a segment that can applied with other artificial lash extensions at the underside of a natural lash) to the underside natural lashes, in accordance with embodiments of the disclosure. Method 400 and each of its individual acts, depicted as blocks 410-460, may be performed by a user applying the lash extensions to their own natural lashes, another person (e.g., a professional lash technician, a cosmetician, a friend, etc.) applying the lash extensions to the user's natural lashes, or any combination thereof. For simplicity of explanation, the methods of this disclosure are depicted and described as a series of acts. However, acts in accordance with this disclosure may occur in various orders and/or concurrently, and with other acts not presented and described within. Furthermore, not all illustrated acts may be required to implement the methods in accordance with the disclosed subject matter. Arranged multiple sets of lash extensions (e.g., segments) may be referred to as a "stacked arrangement" hereafter.

At block 410, an adhesive may be applied to the underside of the natural lashes, such as the upper natural lashes. In some embodiments, rather than the underside, the adhesive may be applied to the top or sides of the upper natural lashes. The adhesive may be one or more of a glue, a mascara, a bonding agent, an epoxy, a paste, or any other natural or synthetic substance having an adhesive quality. In some embodiments, the adhesive may be a waterproof formulation that allows artificial lash extensions to remain affixed to the individual's natural lashes for periods of time (e.g., hours, days, weeks, or months). In some embodiments, the adhesive may be a commercially-available adhesive for conventional lash extensions or a specialized composition for use with the lash extensions described herein. The adhesive may be clear or colored (e.g., milky white or black to emulate mascara).

The adhesive may be applied using a brush, a comb, or any other type of application tool. In some embodiments, the adhesive may be applied one to two millimeters above the waterline. In other embodiments, the adhesive may be applied at any location along the natural lashes or along the waterline. In some embodiments, it may be desirable to wait a predetermined period of time prior to proceeding to block 420 to allow for the adhesive to activate its adhesive quality.

At block 420, a first set of artificial lash extensions (e.g., lash extensions) may be arranged at the underside of the natural lash. In some embodiments, the top side of each base of each of the artificial lash extensions of the first set can be arranged and applied directly to the underside of the natural lashes (rather than to the eyelid). In some embodiments, the first set may be arranged to align with the curvature of the lash line. For example, multiple artificial lash extensions may be arranged adjacent to one another (e.g., not overlapping or overlapping) such that the bases align with the curvature of the lash line. Thus, the first set of artificial lash extensions may become substantially flush with the lash line when the first set is arranged proximate to the lash line. In some embodiments, one or more artificial lash extensions can be arranged at the underside of the natural lash at a time. For example, a single artificial lash extension can be arranged first, another artificial lash extension can be arranged subsequently, and so forth. In some embodiments, an applicator, as described below, can be used to arrange the first set of artificial lash extensions. The user can further re-arrange one or more of the first set of artificial lash extensions as desired.

In some embodiments, each set of artificial lash extensions may include three to eight distinct artificial lash extensions. The number of artificial lash extensions within each set may be based on the width of the artificial lash extension, the thickness of the artificial hair used, the desired style of the eyelid on which the set is intended to be affixed, the desired lash density (also referred to as "fullness" of the user's lashes), etc.

In some embodiments, the first set may include similar artificial lash extensions. For example, each artificial lash extension in the first set can be of a similar length, similar style (e.g., straight artificial hairs as depicted in FIG. 2, crisscrossed artificial hairs as depicted in FIG. 3, number of clusters within each artificial lash extension, etc.), similar color, similar number of artificial hairs or clusters, etc. In some embodiments, the first set may include two or more different artificial lash extensions. For example, two or more artificial lash extensions in the first set can be of a different length, different style, different color, different number of artificial hairs or clusters etc.

In some embodiments, rather than applying adhesive to the underside of the natural lashes (as discussed at block 410) and then arranging the first set of artificial lash extensions to the underside of the natural lash (as discussed at block 420), the adhesive may be applied to the topside of each artificial lash extension, and then the artificial lash extensions may be arranged to the underside of the natural lash.

At block 430, each of the artificial lash extensions may be affixed (e.g., attached or bonded) to the underside of the natural lash. In some embodiments, once the first set of artificial lash extensions are arranged in a desired arrangement, the artificial lash extensions can be affixed so that the artificial lash extensions are secured to and more permanently attached (e.g. for days) to a surface, such as the underside of the natural lash. In some embodiments, one or more of an application of pressure or passage of time to cure the adhesive can be used to help affix the set of artificial lash extensions. In some embodiments, an applicator may be used to affix (e.g., apply pressure) the artificial lash extensions to the natural lashes. The applicator may be any tool having opposed arms that are connected to one another at an end. The opposed arms may be gripped and used to apply a pressing force. In some embodiments, the applicator may have a curved, concave or crescent shape that is contoured to be substantially flush with the curved shape of the lash line. The applicator may be composed of any material (e.g., stainless steel, hardened steel, or titanium) to increase the durability and grasping precision of the opposed arms.

In some embodiments, the applicator may be used to grasp the multiple artificial lash extensions in the first set, and then (by applying pressure to the opposed arms) simultaneously apply pressure to the multiple artificial lash extensions along the lash line (and the natural lash) in a single motion. In other embodiments, the applicator may be used to grasp each artificial lash extension individually. For example, the user may arrange a first artificial lash extension to the underside of the natural lash, affix the artificial lash extension using the applicator, then apply a second artificial lash extension to a location adjacent to the first artificial lash extension, affix the second artificial lash extension using the applicator, and continue this process until each artificial lash extension of the first set is arranged and affixed. In some embodiments, the user may wait to affix first set of artificial lash extensions until one or more of artificial lash extensions of the second set are arranged. In some embodiments, the act of arranging and affixing can be combined into a single act.

At block 440, an adhesive may be applied to the bottom sides (e.g., underside) of the artificial lash extensions of the first set. In some embodiments, the user can apply the adhesive to the top or sides of the one or more lash fusions of the first set. Similar to block 410, the adhesive may be a glue, a mascara, a bonding agent, an epoxy, a paste, or any other natural or synthetic substance having an adhesive quality, and may be applied using a brush, a comb, or any other type of application tool. In some embodiments, the adhesive may be applied to the bottom sides of one or more of the bases of the first set, to the artificial lashes of the first set, to the natural lashes, or any combination thereof.

At block 450, a second set of artificial lash extensions is arranged at the bottom sides of the first set of artificial lash extensions. Similar to the first set, in some embodiments the second set may include multiple artificial lash extensions that are arranged to align with the curvature or shape of the lash line. In some embodiments, the second set may include one or more artificial lash extensions that are similar to the artificial lash extensions of the first set. For example, one or more artificial lash extensions of the second set can be of a similar length, similar style, similar color, similar number of artificial hairs or clusters etc. In some embodiments, the second set may include two or more different artificial lash extensions. For example, two or more artificial lash extensions in the second set can be of a different length, different style, different color, different number of artificial hairs or clusters, etc. In some embodiments, the second set may include artificial lash extensions similar to those in the first set. In some embodiments, the second set may include one or more artificial lash extensions different from those in the first set.

As discussed above, the top side and bottom side (e.g., surface) of the base may be substantially flat. The flatness allows for an improved contact and adhesion to a surface, such as the underside of a natural lash or the opposing surface of another artificial lash extension.

In some embodiments, rather than applying adhesive to the bottom side of the first set of artificial lash extensions (as discussed at block 440) and then arranging the second set of artificial lash extensions to the bottom side of the first set of artificial lash extensions (as discussed at block 450), adhesive may be applied to the top side of the base of each artificial lash extension of the second set, and then the second set may be arranged to the bottom side of the first set of artificial lash extensions.

In relation to the first set, the second set may be arranged in a brick stack arrangement, an aligned stack arrangement, a longitudinally offset arrangement (also referred to as "offset arrangement" herein), or any combination thereof. Each arrangement will be discussed in further detail with regards to FIGS. 5A-7.

At block 460, each of the artificial lash extensions of the second set may be affixed (e.g., attached) to the bottom side of the of the artificial lash extensions of the first set. Similar to block 430, the applicator may used to affix the artificial lash extensions of the second set to the artificial lash extensions of the first set. In some embodiments, the applicator may be used to grasp the multiple artificial lash extensions in the second set, and then (by applying pressure to the opposed arms) simultaneously apply pressure to the multiple artificial lash extensions along the lash line in a single motion. In other embodiments, the applicator may be used to grasp each artificial lash extension individually. For example, the user may arrange a first artificial lash extension associated with the second set to the bottom side of one or more artificial lash extensions of the first set, affix the artificial lash extension using the applicator, then apply a second artificial lash extension associated with the second set to a location adjacent to the first artificial lash extension, affix the second artificial lash extension using the applicator, and continue this process until each artificial lash extension of the second set is arranged and affixed.

Method 400 is discussed in regards to the stacked arrangement of two sets of artificial lash extensions. In some embodiments, the acts discussed in blocks 440-460 can be repeated to add additional sets of stacked artificial lash extensions to the underside of the natural lashes. For example, due to the light weight of the artificial lash extensions, three through ten or more total sets of artificial lash extensions may be affixed to the underside of the natural lash. Therefore, the artificial lash extensions may more easily adhere to a user's natural lashes and remain secured for longer periods of time.

Figure 5A:
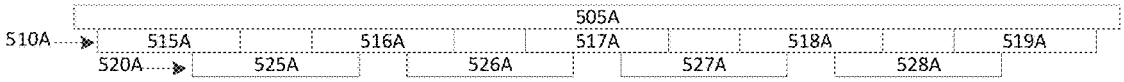
FIGS. 5A-B are illustrations depicting the brick stack arrangement, in accordance with embodiments of the disclosure.
Figure 5B:
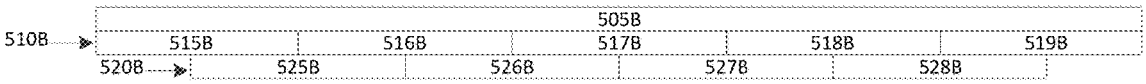

FIGS. 5A-B are illustrations depicting the brick stack arrangements, in accordance with embodiments of the disclosure. The views of FIGS. 5A-B depict the backsides of the bases of the artificial lash extensions. FIG. 5A shows first set 510A having five artificial lash extensions 515A-519A arranged at the underside of lash line 505A. In some embodiments, one or more of the artificial lash extensions 515A-519A may be arranged with a gap between any two adjacent artificial lash extensions (e.g., a gap between artificial lash extension 515A and 516A, a gap between artificial lash extension 516A and 517A, and so on). Second set 520A includes four artificial lash extensions 525A-528A which may be arranged on the bottom side of the first set 510A in a staggered pattern (e.g., artificial lash extension 525A is arranged on the bottom side of both artificial lash extension 515A and 516A, artificial lash extension 526A is arranged on the bottom side of both artificial lash extension 516A and 517A, and so on). In some embodiments, one or more of the artificial lash extensions 525A-528A may be arranged with artificial lash extensions 525A-528A. FIG. 5B show first set 510B having five artificial lash extensions 515B-519B arranged at the underside of lash line 505B. One or more of the artificial lash extensions 515A-519B may be arranged with no gap (e.g., overlap or substantially no gap such that lateral sides of the bases are in contact with one another) between any two adjacent artificial lash extensions (e.g., no gap between artificial lash extension 515B and 516B, no gap between artificial lash extension 516B and 517B, and so on). Second set 520B includes four artificial lash extensions 525B-528B which may be arranged on the bottom side of the first set 510B in a staggered pattern (e.g., artificial lash extension 525B is arranged on the bottom side of both artificial lash extension 515B and 516B, artificial lash extension 526B is arranged on the bottom side of both artificial lash extension 516B and 517B, and so on.) Adjusting the size of the gap may increase or decrease the density of the artificial lashes in the stacked arrangement. It can be understood that the number of artificial lash extensions used in FIGS. 5A-B is by way of example, and any amount of artificial lash extensions in either the first set 510A-B or the second set 520A-B may be used. It can be understood that any combination of arrangement of the artificial lash extensions, as described herein, can be implemented. In can also understood that in some embodiments any lash extensions of a stacked arrangement can be arranged in any of the arrangements or combinations of arrangements as described herein and other lash extensions of the same stacked arrangement can be arranged in a different (or similar) arrangements of combinations of arrangements. The different arrangements as described herein illustrate the different relative positioning of artificial lash extensions in respective stacked arrangements. In some embodiments, the different relative positioning of the various arrangements can be mixed and matched in a particular arrangement as desired. In some embodiments, a brick stacking arrangement can include an arrangement of lashes where at least one artificial lash extension of the second step overlaps at least two artificial lash extensions of the first set.

Figure 6:
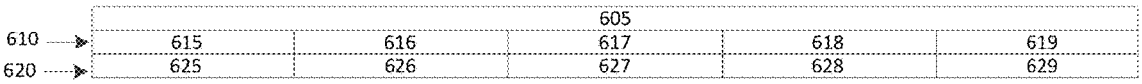
FIG. 6 is an illustration depicting the aligned stack arrangement, in accordance with embodiments of the disclosure.

FIG. 6 is an illustration depicting the aligned stack arrangement, in accordance with embodiments of the disclosure. The view of FIG. 6 depicts the backsides of the bases of the artificial lash extensions. FIG. 6 shows first set 610 of artificial lash extensions having five artificial lash extensions 615-619 arranged at the underside of lash line 605. One or more of the artificial lash extensions 615-619 may be arranged with no gap (e.g., overlap or contact) between any two adjacent artificial lash extensions or a gap between any two adjacent artificial lash extensions (not shown). Second set 620 includes five artificial lash extensions 625-629 which may be arranged on the bottom side of the first set 610 in an aligned pattern (e.g., artificial lash extension 625 is arranged on the bottom side artificial lash extension 615, artificial lash extension 626 is arranged on the bottom side of artificial lash extension 616A, and so on).

Figure 7A:
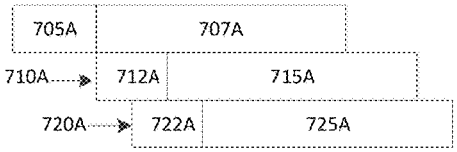
FIGS. 7A-C are illustrations depicting the longitudinally offset arrangement, in accordance with embodiments of the disclosure.
Figure 7B:
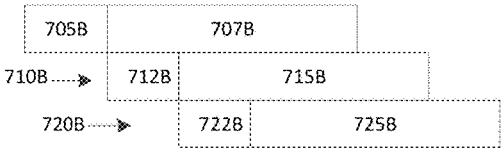
Figure 7C:
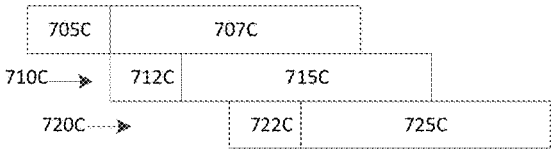

FIGS. 7A-C are illustrations depicting the longitudinally offset arrangement, in accordance with embodiments of the disclosure. The views of FIGS. 7A-C depict a profile view of the artificial lash extensions. In particular, one or more of the second set of artificial lash extensions may have different alignments from the first set of artificial lash extensions. For example, the backside of an artificial lash extension base of the second set may be offset, by a desired distance, from a front side of an artificial lash extension base of the first set along the direction of the artificial lashes or the natural lashes. FIG. 7A shows artificial lash extension 710A (including base 712A and artificial hairs 715A), which is associated with the first set, arranged on the underside of lash line 705A (including natural lashes 707A). Artificial lash extension 720A (including base 722A and artificial hairs 725A), which is associated with the second set, is arranged on the bottom side of artificial lash extension 710A. In particular, the top side of base 722A is partially attached to the bottom side of base 712A and partially attached to the bottom side of artificial hairs 715A. As such, artificial lash extension 720A is offset longitudinally from artificial lash extension 710A.

FIG. 7B shows artificial lash extension 710B (including base 712B and artificial hairs 715B), which is associated with the first set, arranged on the underside of lash line 705B (including natural lashes 707B). Artificial lash extension 720B (including base 722B and artificial hairs 725B), which is associated with the second set, is arranged on the bottom side of artificial lash extension 710B. In particular, the top side of base 722B is attached to the bottom side of bottom side of artificial hairs 715A, adjacent to base 712B (e.g. not attached to base 712B). As such, artificial lash extension 720B is offset longitudinally from artificial lash extension 710B, and has a greater offset that the embodiment discussed in FIG. 7A.

FIG. 7C shows artificial lash extension 710C (including base 712C and artificial hairs 715C), which is associated with the first set, arranged on the underside of lash line 705C (including natural lashes 707C). Artificial lash extension 720C (including base 722C and artificial hairs 725C), which is associated with the second set, is arranged on the bottom side of artificial lash extension 710C. In particular, the top side of base 722C is attached to the bottom side of artificial hairs 715C and not adjacent to base 712C. As such, artificial lash extension 720C is offset longitudinally from artificial lash extension 710C, and has a greater offset that the embodiments discussed in FIGS. 7A-C.

It should be understood that any combination of the brick stack arrangement, the aligned stack arrangement, and the longitudinally offset arrangement can be used by the disclosure. For example, the second set of artificial lash extensions can be arranged in a brick stack arrangement and a longitudinally offset arrangement in relation to the first set of artificial lash extensions.

Figure 8C:
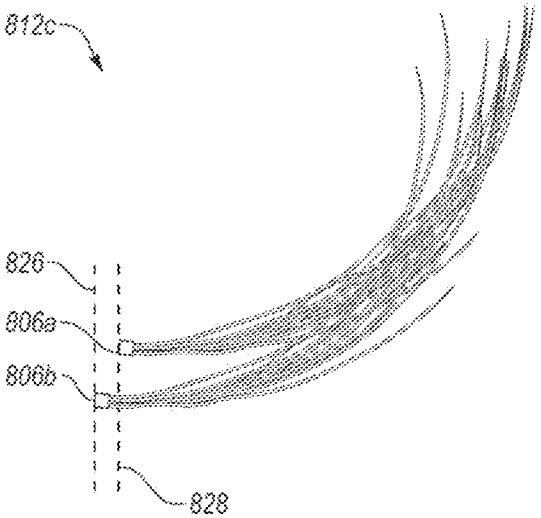
FIGS. 8A-8C are illustrations depicting examples of stacked artificial lash extensions, in accordance with embodiments of the disclosure.
Figure 8B:
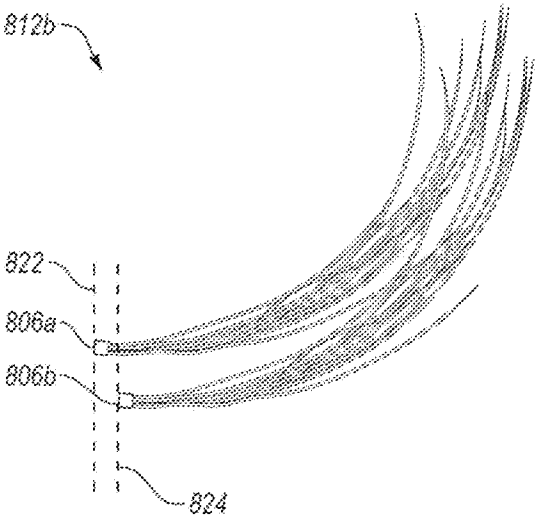
Figure 8A:
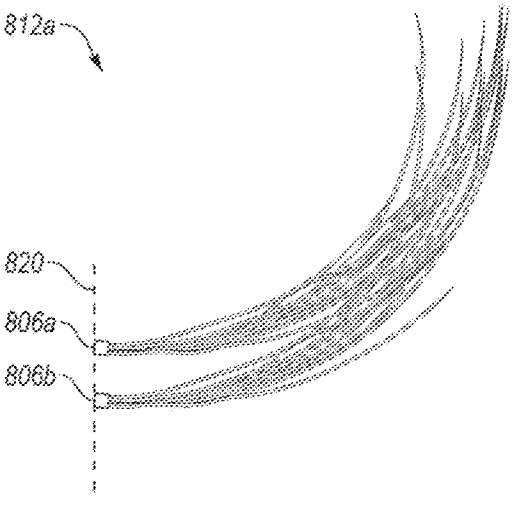

FIGS. 8A-8C are illustrations depicting examples of stacked artificial lash extensions 812A-C, in accordance with embodiments of the disclosure. Each longitudinally offset arrangements 812A-C shows a pair of artificial lash extensions, each including base 806A-B from which multiple artificial hairs protrude, as described herein.

In some embodiments, as shown in FIG. 8A, base 806A may be stacked with base 806B in an aligned (e.g., in an aligned stack arrangement) or staggered (e.g., in a brick stack arrangement) position. For example, the top side of base 806B may be partially or completely affixed to the bottom side base 806A, both of which lie on plane 820. The bases 806A-B may be affixed to each other using an adhesive, as described in FIG. 4.

In some embodiments, as shown in FIG. 8B, base 806B may be longitudinally offset relative to base 806A such that base 806A and 806B are not in contact with each other. As shown, base 806A lies on plane 822 and base 806B lies on plane 824, which is offset from plane 822. In such embodiments, the top side of base 806B may be affixed (using an adhesive) to the artificial hairs of the artificial lash extension associated with base 806A.

In some embodiments, as shown in FIG. 8C, base 806B may be longitudinally offset relative to base 806A such that base 806A and 806B are partially in contact with each other. As shown, base 806A lies on plane 826 and base 806B lies on plane 828, which is offset from plane 826. In such embodiments, the top side of base 806B may be partially affixed (using an adhesive) to the bottom side of base 806A and to the artificial hairs of the artificial lash extension associated with base 806A.

Figure 9A:
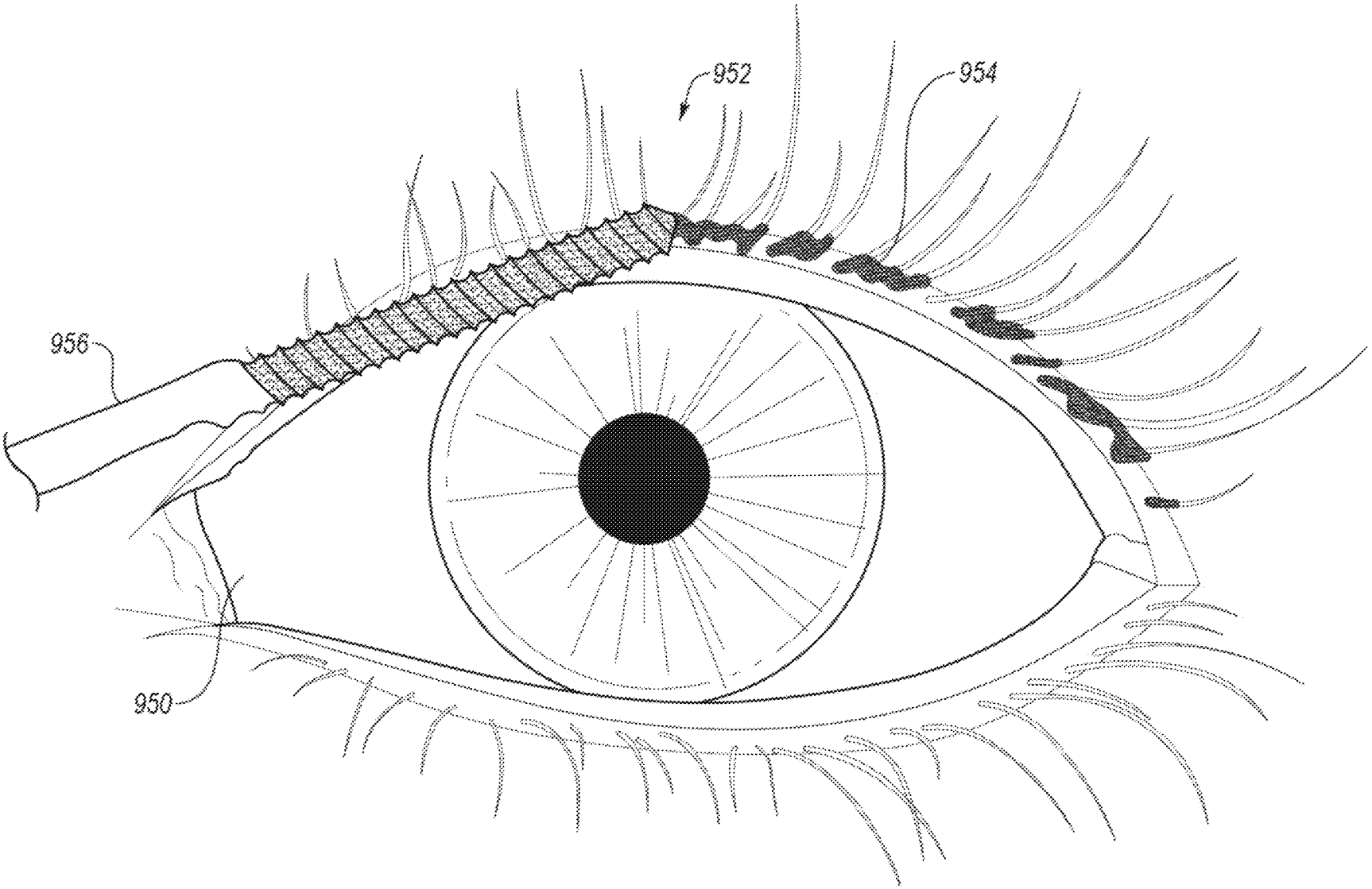
FIGS. 9A-9F are illustrations showing arranging multiple sets of artificial lash extensions to the underside of upper natural lashes in an aligned stack arrangement, in accordance with embodiments of the disclosure.

FIGS. 9A-9F are illustrations showing arranging multiple sets of artificial lash extensions to the underside of upper natural lashes in an aligned stack arrangement, in accordance with embodiments of the disclosure. FIG. 9A shows the adhesive 954 applied using adhesive application tool 956 (e.g., a brush) to the underside of the upper natural lashes 952 of an eye 650. The adhesive may be a glue, a mascara, a bonding agent, an epoxy, a paste, or any other natural or synthetic substance having an adhesive quality.

Figure 9B:
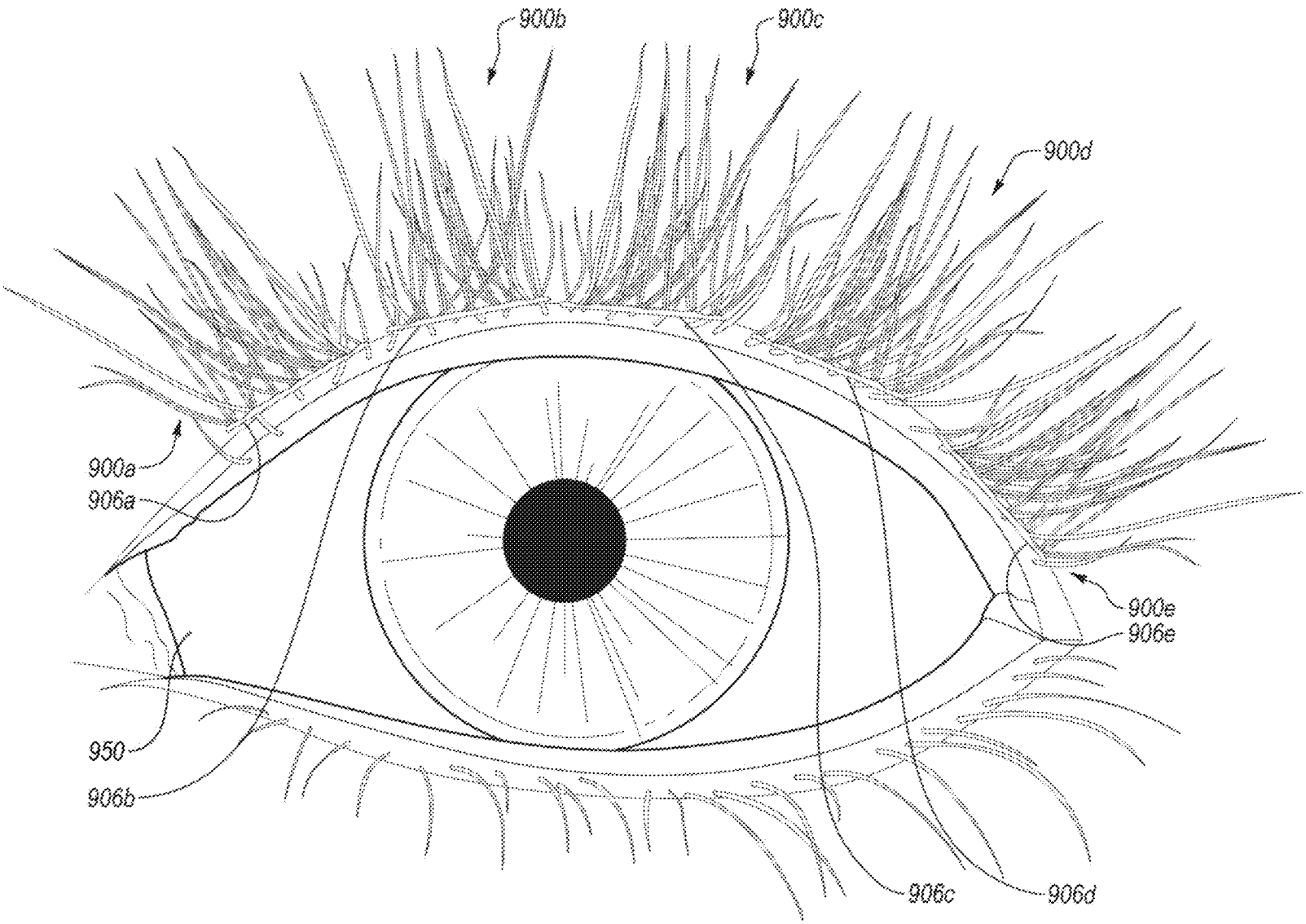
Figure 9C:
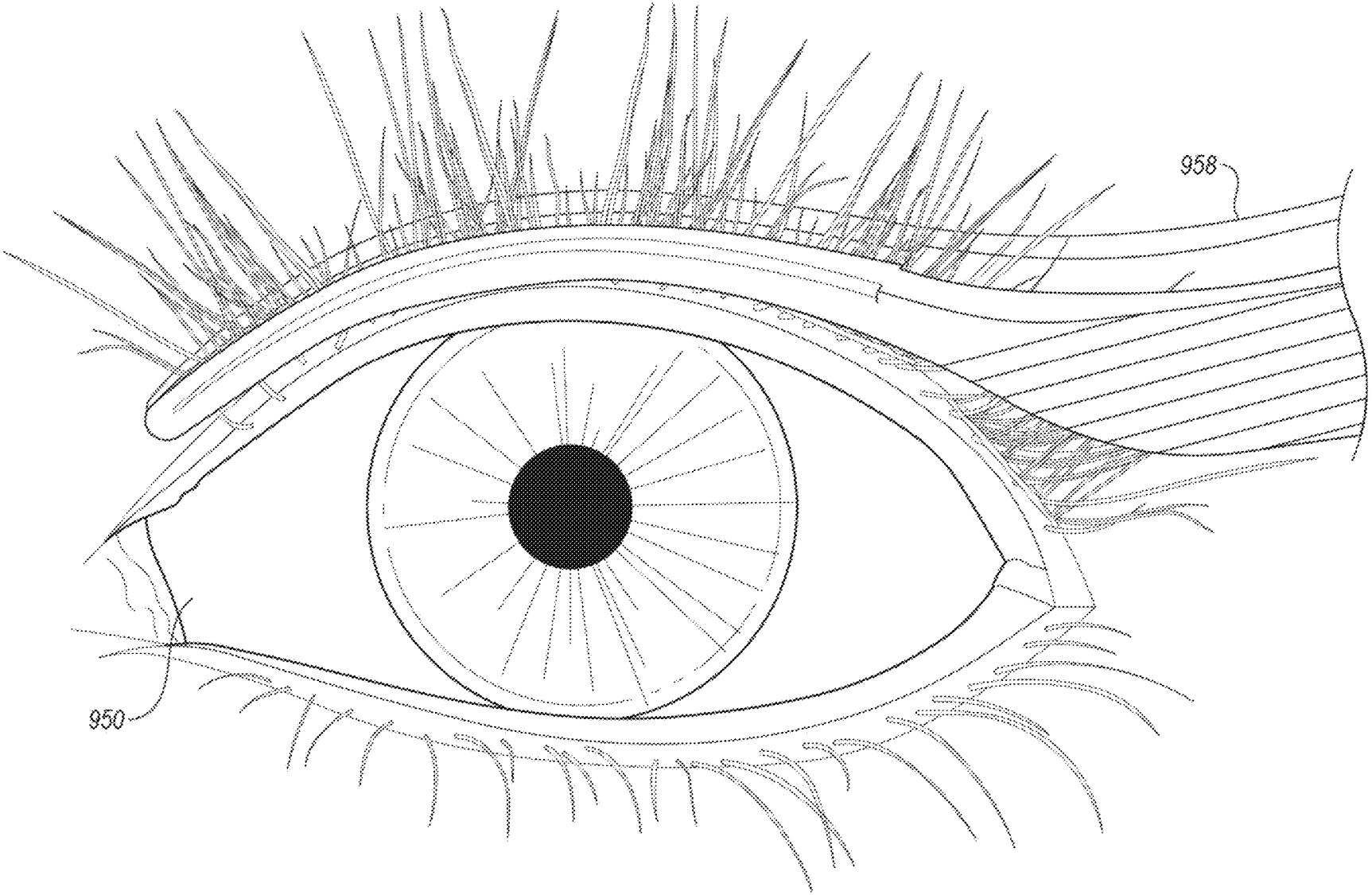

FIG. 9B shows a first set of artificial lash extensions 900A-E, each including a base 906A-E, respectively, arranged on the natural eyelashes 952. Bases 906A-E are arranged proximate to the lash line of the eye 950. In particular, the top side of bases 906A-E are applied to the underside of the natural lashes 952. FIG. 9C shows each of the artificial lash extensions 900A-E affixed to the underside of the natural lash using applicator 958. Applicator 958 may be used to grasp bases 906A-E and simultaneously apply pressure to the multiple artificial lash extensions along the lash line in a single motion.

Figure 9D:
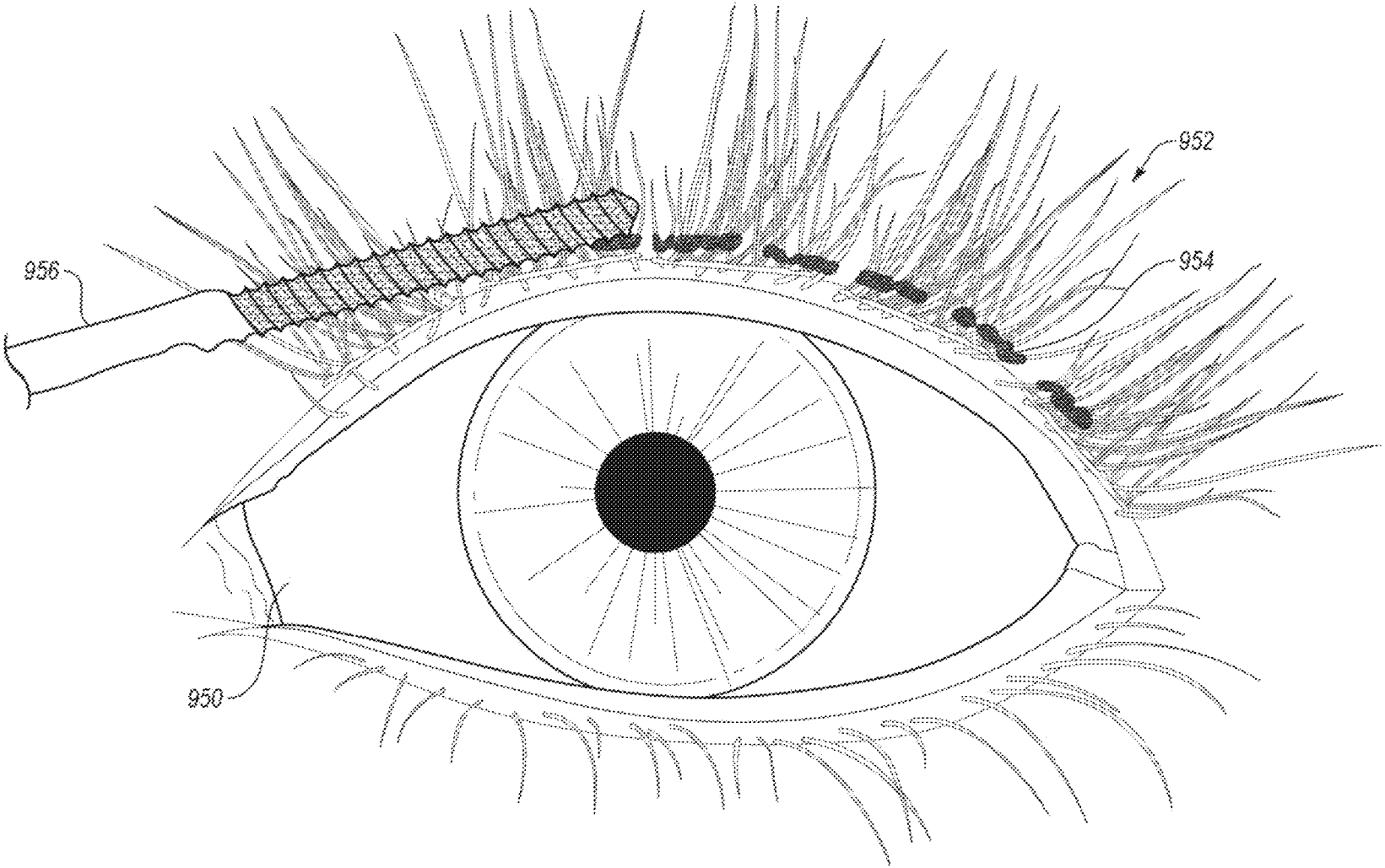
Figure 9E:
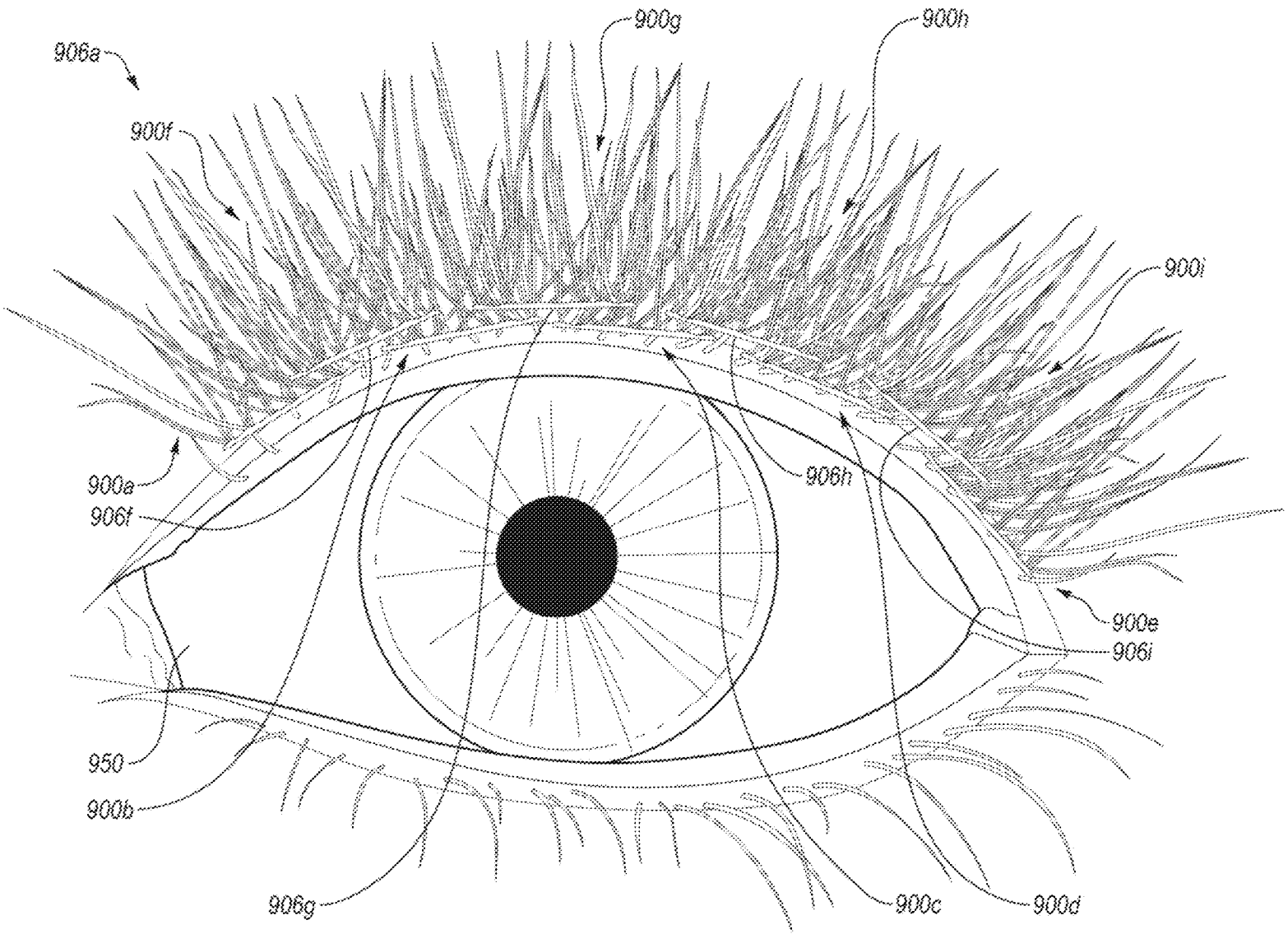
Figure 9F:
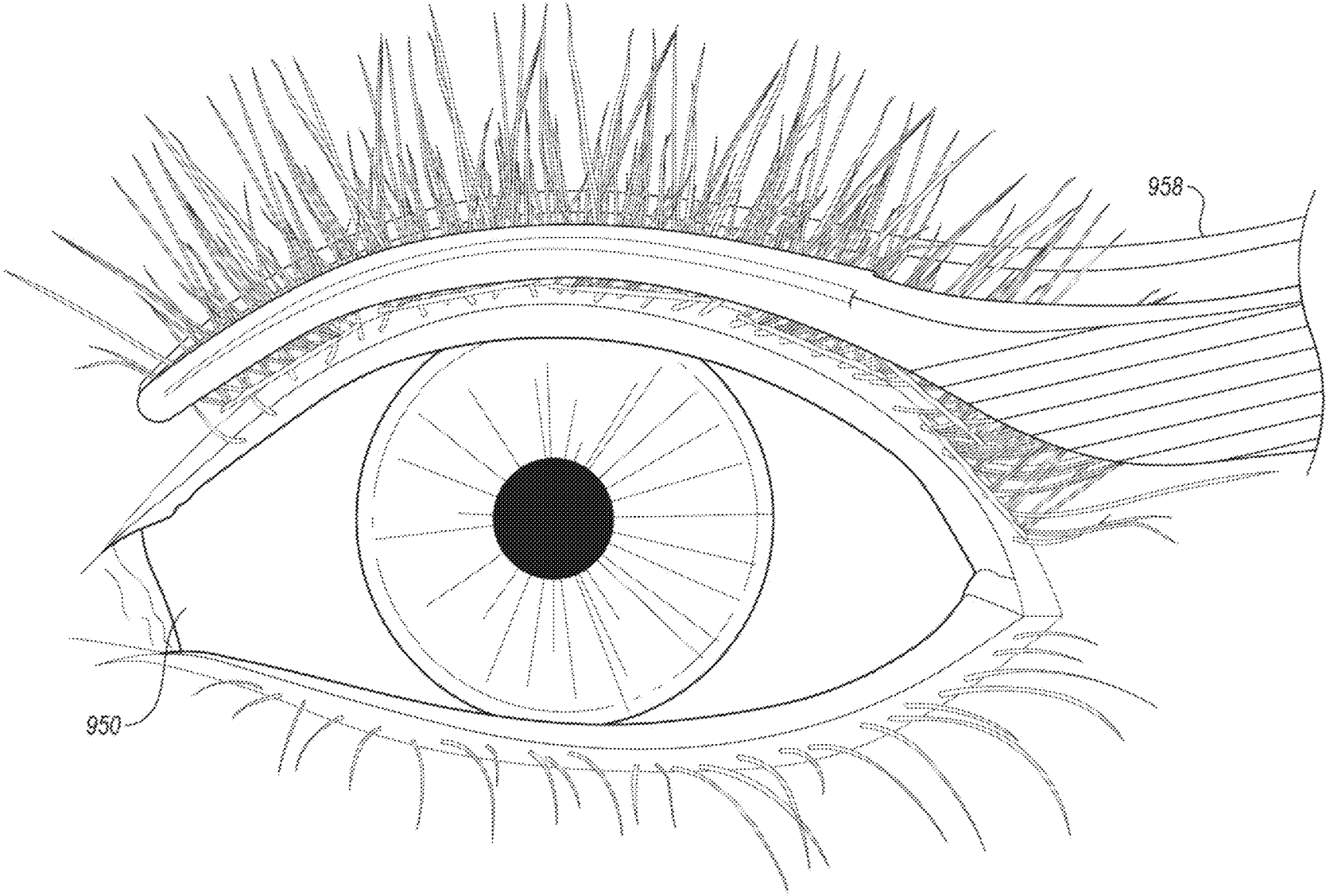

FIG. 9D shows the adhesive 954 applied again using adhesive application tool 956 to the underside of the first set of artificial lash extensions 900A-E. FIG. 9E shows a second set of artificial lash extensions 900F-I, each including a base 906F-I, respectively, arranged to the bottom side of artificial lash extensions 900F-I, respectively. The top side of bases 906F-I can be applied to either the bottom side of bases 906A-E, the artificial hairs of artificial lash extensions 900A-E (as shown), or any combination thereof. FIG. 9F shows each of the artificial lash extensions 900F-I affixed to the bottom side of the artificial lash extensions 900A-E using applicator 958. Applicator 958 may be used to grasp bases 906F-I and simultaneously apply pressure to the multiple artificial lash extensions along the lash line in a single motion. This results in two sets artificial lash extensions stacked in an aligned stack arrangement.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Reference throughout this specification to "one embodiment," "certain embodiments," "one or more embodiments" or "an embodiment" means that a particular feature, structure, material, or characteristic described in connection with the embodiment is included in at least one embodiment of the invention. Thus, the appearances of the phrases such as "in one or more embodiments," "in certain embodiments," "in one embodiment" or "in an embodiment" in various places throughout this specification are not necessarily referring to the same embodiment of the invention. Furthermore, the particular features, structures, materials, or characteristics may be combined in any suitable manner in one or more embodiments.

As used herein, the singular forms "a," "an," and "the" include plural references unless the context clearly indicates otherwise. Thus, for example, reference to "an element" includes a single element as well as two or more different elements. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or." That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances.

What is claimed is:

1. An artificial lash extension system comprising:

a first plurality of lash extensions designed for an application at an underside of upper natural lashes, wherein the underside of the upper natural lashes is a side of the upper natural lashes closest to an upper waterline of an eye, each of the first plurality of lash extensions comprising:

a first plurality of artificial hairs, and a first base from which the first artificial hairs protrude, wherein the first base comprises a substantially flat top side designed to attach to the underside of the upper natural lashes and a substantially flat bottom side designed to attach to at least a portion of a top side of one or more lash extensions of a second plurality of lash extensions, wherein the top side of the first base is configured to enable adhesion to the underside of the upper natural lashes; and the second plurality of lash extensions designed for an application under the first plurality of lashes, each of the second plurality of lash extensions comprising:

a second plurality of artificial hairs, and a second base from which the second artificial hairs protrude, wherein the second base comprises a substantially flat top side designed to attach to at least part of a bottom side of one or more of the first plurality of lash extensions.

2. The artificial lash extension system of claim 1, wherein the bottom sides of the first bases and the top sides of the second bases are substantially flat to facilitate the attachment of the second plurality of lash extensions to the first plurality of lash extensions.

3. The artificial lash extension system of claim 1, wherein the first plurality of lash extensions comprise a first lash extension and the second plurality of lash extensions comprise a second lash extension, wherein the second lash extension is attachable to the first lash extension in an offset arrangement where a backside of the second base of the second lash extension is offset from a front side of the first base of the first lash extension.

4. The artificial lash extension system of claim 1, wherein a second lash extension of the second plurality of lash extensions is attachable to a first lash extension of the first plurality of lash extensions in a staggered arrangement.

5. The artificial lash extension system of claim 1, wherein a second lash extension of the second plurality of lash extensions is attachable to a first lash extension of the first plurality of lash extensions in an aligned stack arrangement.

6. The artificial lash extension system of claim 1, wherein at least one of the first plurality of lash extensions and at least one of the second plurality of lash extensions is at least one of a different length, different style, different color, or comprise a different number of artificial hairs.

7. The artificial lash extension system of claim 1, wherein a first plurality of artificial hairs and the second plurality of artificial hairs comprise polybutylene terephthalate.

8. The artificial lash extension system of claim 1, wherein the top side of the first base comprises a flatness control tolerance value of +/−0.03 mm or +/−0.015 mm.

9. The artificial lash extension system of claim 1, wherein each of the first bases comprises a thickness configured to obscure a user's view of the first bases.

10. The artificial lash extension system of claim 1, wherein the thickness of the first base is between 0.05 mm to 0.15 mm.

11. An artificial lash extension system, comprising:

a container; and a first plurality and a second plurality of lash extensions releasably coupled to the container, a first plurality of lash extensions designed for an application at an underside of upper natural lashes, wherein the underside of the upper natural lashes is a side of the upper natural lashes closest to an upper waterline of an eye, each of the first plurality of lash extensions comprising:

a first plurality of artificial hairs, and a first base from which the first artificial hairs protrude, wherein the first base comprises a substantially flat top side designed to attach to the underside of the upper natural lashes and a substantially flat bottom side designed to attach to at least a portion of a top side of one or more lash extensions of a second plurality of lash extensions, wherein the top side of the first base is configured to enable adhesion to the underside of the upper natural lashes; and a second plurality of lash extensions designed for an application under the first plurality of lashes, each of the second plurality of lash extensions comprising:

a second plurality of artificial hairs, and a second base from which the second artificial hairs protrude, wherein the second base comprises a substantially flat top side designed to attach to at least part of a bottom side of one or more of the first plurality of lash extensions.

12. The artificial lash extension system of claim 11, wherein the bottom sides of the first bases and the top sides of the second bases are substantially flat to facilitate the attachment of the second plurality of lash extensions to the first plurality of lash extensions.

13. The artificial lash extension system of claim 11, wherein the first plurality of lash extensions comprise a first lash extension and the second plurality of lash extensions comprise a second lash extension, wherein the second lash extension is attachable to the first lash extension in an offset arrangement where a backside of the second base of the second lash extension is offset from a front side of the first base of the first lash extension.

14. The artificial lash extension system of claim 11, wherein a second lash extension of the second plurality of lash extensions is attachable to a first lash extension of the first plurality of lash extensions in a staggered arrangement.

15. The artificial lash extension system of claim 11, wherein a second lash extension of the second plurality of lash extensions is attachable to a first lash extension of the first plurality of lash extensions in an aligned stack arrangement.

16. The artificial lash extension system of claim 11, wherein at least one of the first plurality of lash extensions and at least one of the second plurality of lash extensions is at least one of a different length, different style, different color, or comprise a different number of artificial hairs.

17. The artificial lash extension system of claim 11, wherein a first plurality of artificial hairs and the second plurality of artificial hairs comprise polybutylene terephthalate.

* * * * *